US010138684B2

(12) United States Patent
Adam

(10) Patent No.: US 10,138,684 B2
(45) Date of Patent: Nov. 27, 2018

(54) MULTI CYCLE DOWNHOLE TOOL

(71) Applicant: NOV Downhole Eurasia Limited, Gloucestershire (GB)

(72) Inventor: Mark Adam, Aberdeen (GB)

(73) Assignee: NOV DOWNHOLE EURASIA LIMITED, Gloucestershire (GB)

( * ) Notice: Subject to any disclaimer, the term of this patent is extended or adjusted under 35 U.S.C. 154(b) by 220 days.

(21) Appl. No.: 15/100,204

(22) PCT Filed: Nov. 27, 2014

(86) PCT No.: PCT/GB2014/053509
§ 371 (c)(1),
(2) Date: May 27, 2016

(87) PCT Pub. No.: WO2015/079232
PCT Pub. Date: Jun. 4, 2015

(65) Prior Publication Data

US 2017/0058612 A1 Mar. 2, 2017

(30) Foreign Application Priority Data

Nov. 29, 2013 (GB) ..... 1321137.0

(51) Int. Cl.
*E21B 10/32* (2006.01)
*E21B 23/04* (2006.01)
(Continued)

(52) U.S. Cl.
CPC ..... *E21B 10/322* (2013.01); *E21B 7/28* (2013.01); *E21B 23/04* (2013.01);
(Continued)

(58) Field of Classification Search
CPC ..... E21B 10/322; E21B 7/28; E21B 23/04; E21B 47/12; E21B 29/002; E21B 17/1014; E21B 10/26; E21B 10/28; E21B 10/30
See application file for complete search history.

(56) References Cited

U.S. PATENT DOCUMENTS

2003/0155155 A1 8/2003 Dewey et al.
2004/0060710 A1 4/2004 Marshall
(Continued)

FOREIGN PATENT DOCUMENTS

WO 2004/097163 A1 11/2004
WO 2007/017651 A1 2/2007
WO 2010/116152 A2 10/2010

OTHER PUBLICATIONS

PCT/GB2014/053509 International Search Report and Written Opinion dated Jul. 30, 2015 (13 p.).
GB1321137.0 UK Search Report dated May 29, 2014 (3 p.).

*Primary Examiner* — Brad Harcourt
(74) *Attorney, Agent, or Firm* — Conley Rose, P.C.

(57) ABSTRACT

An under-reaming tool comprises a body and a plurality of extendable cutters mounted on the body. The under-reaming tool is configured to be cycled between a first configuration in which the cutters are retracted and a second configuration in which the cutters are movable between retracted and extended positions. The under-reaming tool is configured to prevent extension of the cutters by an external fluid in the first and/or second configuration/s.

22 Claims, 10 Drawing Sheets

(51) Int. Cl.

| | |
|---|---|
| ***E21B 7/28*** | (2006.01) |
| *E21B 17/10* | (2006.01) |
| *E21B 29/00* | (2006.01) |
| *E21B 47/12* | (2012.01) |

(52) U.S. Cl.
CPC ..... *E21B 17/1014* (2013.01); *E21B 29/002* (2013.01); *E21B 47/12* (2013.01)

(56) References Cited

U.S. PATENT DOCUMENTS

| | | | | |
|---|---|---|---|---|
| 2012/0055714 | A1* | 3/2012 | Adam ..... | E21B 10/322 175/57 |
| 2012/0073879 | A1 | 3/2012 | Makkar et al. | |
| 2014/0284104 | A1 | 9/2014 | Clausen et al. | |

* cited by examiner

MULTI CYCLE DOWNHOLE TOOL

CROSS-REFERENCE TO RELATED APPLICATIONS

This application is a 35 U.S.C. § 371 national stage application of PCT/GB2014/053509 filed Nov. 27, 2014 and entitled "Multi Cycle Downhole Tool," which claims priority to British Application No. GB 1321137.0 filed Nov. 29, 2013 and entitled "Multi Cycle Downhole Tool," both of which are hereby incorporated herein by reference in their entirety for all purposes.

STATEMENT REGARDING FEDERALLY SPONSORED RESEARCH OR DEVELOPMENT

Not applicable.

FIELD OF THE INVENTION

This invention relates to a downhole tool with an activation member for multiple use downhole, and associated methods; and in particular, but not exclusively, to a downhole tool having extendable members, such as an underreamer, casing cutter or adjustable stabiliser.

BACKGROUND OF THE INVENTION

In the oil and gas industry, downhole tools are used to perform various operations during exploration, production, maintenance or decommissioning. The tools often form part of a tool string that travels downhole, such as a drill string for drilling a bore in an underground formation. Typically the downhole tools perform different functions during different stages of downhole operations. For example, downhole tools are often transported to and from a particular location in a bore and only activated for use at the particular location for a specific interval, such as to perform a local operation such as packing or reaming or perforating, or the like.

It is often unsuitable to transport the downhole tools in an active configuration. For example, there are numerous downhole tools that feature radially extendable members. Blades or cutters such as on an underreamer are radially extendable to allow the underreamer to pass through a restriction or a casing with the blades in a relatively compact radial configuration. When the undereamer passes out of the end of the casing in a bore, the blades are extended to allow the bore to be drilled to a diameter greater than the internal diameter of the casing.

During an underreaming operation the blades can be subjected to high radial forces so, to ensure effective cutting, the blades are radially supported in the extended configuration. Examples of underreamers are described in applicant's International (PCT) Application Publication No.s WO 2004/097163 and WO 2010/116152, the disclosures of which are incorporated herein by reference. Upon completion of an underreaming operation, the blades are retracted to allow the toolstring including the undereamer to be retrieved from the bore. Failure to retract the blades, or to retain the blades in a retracted configuration during retrieval of the underreamer, causes the blades to contact the existing casing. A blade retraction failure of the underreamer makes it difficult, sometimes impossible, to retrieve the underreamer and can also cause damage to the casing or other equipment in the bore.

SUMMARY OF THE INVENTION

According to a first aspect of the invention, there is provided a tool, such as an under-reaming tool. The tool may comprise a body. The tool may comprise one or more laterally extendable member/s. The laterally extendable members may comprise a plurality of extendable cutters mounted on the body. The tool may be configured to be cycled between a first configuration in which the one or more laterally extendable member/s are retracted and a second configuration in which the one or more laterally extendable member/s are movable between retracted and extended positions. The tool may configured to prevent extension of the one or more laterally extendable member/s by an external fluid in the first and/or second configuration/s.

The tool may configured to prevent extension of the one or more laterally extendable member/s by an external fluid pressure in the first and/or second configuration/s.

The tool may configured to prevent extension of the one or more laterally extendable member/s by an external fluid entering the tool in the first and/or second configuration/s.

According to a further aspect of the invention, there is provided a drill-string comprising a tool according to any other aspect.

The tool may be configured to allow extension of the cutters only in the second configuration. The cutters may be extendable only in the second configuration. The tool may be configured to allow extension of the cutters only in response to an internal fluid pressure within the body and/or an internal fluid flow through or within the body. The tool may be configured to allow extension of the cutters only in response to a toolbore pressure, or toolbore overpressure. The tool may be configured to allow extension of the cutters only in response to an internal fluid pressure within the body exceeding the external fluid pressure.

The tool may comprise an internal fluid passage. The internal fluid passage may comprise an axial fluid passage. The fluid passage may comprise an internal bore. The internal bore may comprise a tool bore. The internal bore may comprise a throughbore. The body may comprise the internal fluid passage. The tool bore may form part of a drill-string bore. The tool bore may be configured to be in fluid communication with one or more other drill-string components or assemblies.

The tool may be configured to only allow extension of the cutters in response to a higher internal pressure relative to an external pressure. The tool may be configured to prevent extension of the cutters when the external pressure exceeds an internal pressure.

The tool when configured such that the cutters are driven or biased to the retracted position can be defined as set in the first configuration.

The tool when configured such that the cutters are driven to the extended position can be defined as set in the second configuration.

Providing such a tool may prevent unwanted extension and/or ensure retraction of cutters. For example, such a tool may prevent extension of cutters when encountering a higher than expected external fluid pressure. Such a tool may prevent extension and/or ensure retraction of cutters during tripping in hole when high external hydrostatic pressure annular to tool body may exceed the hydrostatic pressure within the tool bore. Such a tool may obviate or at least mitigate against the possibility of cutter blades extending into casing bore and hanging up drill string during trip in hole.

The tool may be configured to be subjected to a plurality of pressure conditions. The tool may be configured to be subjected to at least three pressure conditions.

A first pressure condition may be defined as internal pressure, such as tool bore pressure, being greater than the pressure external to the tool body.

A second pressure condition may be defined as the pressure external to the tool body being greater than the internal or tool bore pressure.

A third pressure condition may be defined as the internal or tool bore pressure being equal to the pressure external to the tool body.

Although referred to as first, second and third pressure conditions, it will be appreciated that the tool may be subjected to pressure conditions in any other order. For example, the tool may be initially subjected to the second or third pressure conditions, such as when running-in; and subsequently subject to the first pressure condition.

The first pressure condition (e.g. high internal or tool bore pressure relative to low pressure external to the tool body) may be achieved when a drilling fluid is pumped through the tool bore.

The tool, such as an under-reamer, may be positioned in a bottom hole assembly of a drill string. The under-reamer may be positioned above one or more drilling components. Downhole of the under-reamer tool there may be a drill bit. The drill-string may also include additional components, such as selected from one or more of: a rotary steerable tool and/or a measurement while drilling tool (MWD) and/or a logging while drilling tool (LWD). The drill-string may be configured such that a fluid flowing through the drill string bore generates a pressure drop across each bottom hole assembly component. The pressure drop may effectively be the pressure differential between the tool bore pressure and the annular pressure external to tool body. The pressure differential between the drill string bore and the annulus external to the drill string may increase cumulatively above each bottom hole assembly component.

The tool may comprise one or more piston/s. The/each piston may be configured to act within the under-reamer in an axial direction. The axial direction of action of the/each piston may be dependent upon a polarity of the pressure differential between the tool bore pressure and the annular pressure external to the tool body.

The tool may comprise an activation member. The activation member may comprise a first piston. The first piston may comprise an activation piston. The activation piston may be configured within the under-reamer to act in an axial direction to drive, such as directly drive, the cutters to the extended position. The activation piston may comprise or be operatively associated with, such as attached to, a cam mechanism to drive the cutters. The cam mechanism may be configured to convert or translate the axial movement and/or force of the activation piston to a movement and/or force with at least a radial component to extend the cutters laterally. The first piston may be configured to provide a negligible or no axial bias when not selected or activated, such as in the first configuration. The first piston may be configured to provide a bias, such as a hydraulic bias, when selected or activated.

The tool may comprise a second piston. The second piston may comprise a retraction piston. The retraction piston may be configured within the under-reamer to act in an opposing axial direction to the activation piston. The retraction piston may be used against the activation piston to drive, such as directly drive, and/or bias the cutter blades to the retracted position.

The tool may comprise a third piston. The third piston may comprise a conditional piston. The conditional piston may comprise a counterpiston.

The conditional piston may be configured to act in the opposing direction to the retraction piston, at least as a result of fluid pressure/s. The conditional piston may be configured to act in the opposing direction to the retraction piston at least when the tool is subject to the first pressure condition. The conditional piston may be configured to act in the same direction as the activation piston, at least as a result of fluid pressure/s. The conditional piston may be configured to act in the same direction as the activation piston, at least when the tool is subject to the first pressure condition. The conditional piston may be configured to act in the same direction as the activation piston, at least when the tool is in the second configuration.

The conditional piston may be configured to act in an opposite direction when the tool is subject to the second pressure condition compared to when the tool is subject to the first pressure condition. The conditional piston may change direction when the pressure condition changes between the first and second pressure conditions.

The retraction piston may be configured to exert a different magnitude of bias than the conditional piston. The retraction piston may be configured to exert a smaller bias force than the conditional piston. The conditional piston may be configured to resist movement of the activation member in one direction (e.g. the first or second direction, such as uphole or downhole), at least when subject to the second pressure condition in the first and/or second configurations. The retraction piston may be configured to resist movement of the activation member in the same direction (e.g. the first or second direction, such as uphole or downhole) when the tool is subject to the first pressure condition.

The first configuration may comprise an inactive configuration. The second configuration may comprise an active configuration. The tool may be configured to retract and/or prevent extension of the cutters when the tool is in the first configuration. The tool may be configured to retract and/or prevent extension of the cutters when the tool is in the first configuration and subjected to the first and/or second and/or third pressure condition/s. The tool may be configured to retract and/or prevent extension of the cutters when the tool is in the second configuration and subjected to the second and/or third pressure condition/s. The three pistons may combine within the under-reamer tool such that when the under-reamer is set in the first configuration the cutters remain retracted when the internal or tool bore pressure exceeds the external or annular pressure. The three pistons may combine within the under-reamer tool such that when the under-reamer is set in the first configuration the cutters remain retracted when the external or annular pressure exceeds the internal or tool bore pressure.

The tool may be configured to extend and/or maintain the cutters in the extended position only when the tool is in the second configuration and subjected to the first pressure condition. The tool may be configured to retract and/or prevent extension of the cutters when the tool is in the second configuration and subjected to the second and/or third pressure condition/s. The three pistons may combine within the tool such that when the tool is in the second configuration the cutters will move and/or be biased to the extended position only when the internal or tool bore pressure exceeds the external or annular pressure.

The tool may comprise a mechanical biasing member. The mechanical biasing member may act in combination with one or more of the pistons to ensure the cutter blades remain retracted when the internal or tool bore pressure and the external or annular pressure are substantially equal.

The tool may comprise one or more internal fluid chambers. The tool may comprise one or more internal fluid chambers and/or lateral or diametric area/s exposed to internal or tool bore pressure.

The plurality of pistons may be configured to utilise the fluid chamber/s and/or diametric area/s in various combinations of external pressure or internal or tool bore pressure to selectively produce a single net piston force in a variety of axial directions. The plurality of pistons may be configured to utilise variations in relative pressures between the respective fluid chambers to vary the single net piston force (e.g. a single net piston force resultant from The net piston force may be defined to act in a first direction. The first direction may be axial. The first direction may be defined in a direction such as to retract the blades. The first direction may be uphole. Alternatively, the first direction may be downhole.

The net piston force may be defined or redefined to act in a second direction. The second direction may be defined or redefined in a direction such as to extend the cutter blades. The second direction may be axial. The second direction may be substantially opposite to the first direction. The second direction may be downhole. Alternatively, the second direction may be uphole.

The under-reamer tool may comprise a first fluid chamber and a second fluid chamber.

The activation piston may be positioned within the under-reamer such that is subject, at least partially, to pressure from or in the first fluid chamber and pressure from or in the second fluid chamber. The activation piston may be positioned between the first and second fluid chambers. The activation piston may be axially positioned between the first and second fluid chambers.

The under-reamer tool body may comprise one or more ports. The/each port may communicate external fluid pressure to the internal fluid chambers and/or vice versa.

The tool body may comprise one or more ports communicating external fluid to and/or from the first fluid chamber, such as a first fluid chamber port.

The tool body may comprise one or more ports communicating external fluid to and/or from the second fluid chamber, such as a second fluid chamber port.

The first fluid chamber port/s may define a first fluid flow area.

The first fluid flow area may allow fluid flow or fluid pressure to enter the first fluid chamber from the annular volume external to the tool body.

The first fluid flow area may allow fluid flow or fluid pressure to exit the first fluid chamber to the annular volume external to tool body.

The first fluid chamber may comprise one or more port or ports enabling fluid communication between the first fluid chamber and the internal or tool bore, such as one or more further first fluid chamber ports. The one or more further first fluid chamber ports may comprise a configurable port/s. The one or more further first fluid chamber ports may define a second fluid flow area.

The first fluid chamber port may provide fluid communication between the first fluid chamber and the internal or tool bore in the first and/or second configurations.

Where the first fluid chamber port does not provide fluid communication between the first fluid chamber and the internal or tool bore in the first configuration, the first fluid chamber may be effectively sealed from the internal or toolbore pressure. Accordingly the first fluid chamber may be isolated from the internal pressure, such as subject to the external pressure. The further first fluid chamber port may be substantially replaced and/or supplemented by an opening or an increased opening of the first fluid chamber port in the second configuration relative to the first configuration.

The second fluid flow area may allow fluid flow or fluid pressure to enter the first fluid chamber from the internal or tool bore.

The second fluid flow area may allow fluid flow or fluid pressure to exit the first fluid chamber to the internal or tool bore.

The second fluid flow area may define a fluid flow area substantially larger than the first fluid flow area.

The first and/or second fluid flow area/s may define a larger total flow area between the first fluid chamber and the internal or tool bore in the second configuration than in the first configuration.

The activation piston may comprise a first sealing area between the internal or tool bore and the first fluid chamber.

The activation piston may comprise a second sealing area between the first fluid chamber and the second fluid chamber.

The activation piston may comprise a third sealing area between the internal or tool bore (pressure) and the second fluid chamber.

The first and third sealing areas may each and/or in combination define a relatively small sealing or piston area/s compared to the second sealing area.

The second sealing area may define a significantly larger sealing or piston area than the first and/or third sealing area/s, combined and/or individually.

The first and third sealing areas may define sealing or piston areas that are substantially equal or of marginal difference.

The tool may comprise a selection member or device. The selection member or device may be configured to control a pressure differential across the activation piston. The selection member or device may be configured to control fluid flow or pressure in the first and/or second fluid chamber/s. The selection member or device may be configured to control fluid flow through the second fluid flow area.

The selection member or device may be selectively operable to allow the activation piston to activate the tool and/or the cutters. The selection member or device may be selectively actuated to allow the tool to be reconfigurable between the first configuration and the second configuration.

The selection member may be configured to prevent or restrict fluid flow through the first and/or second fluid flow area/s into the first fluid chamber when the tool is in the first configuration.

The selection member may be configured to prevent or restrict internal or tool bore fluid or pressure from entering the first fluid chamber when the tool is in the first configuration. The selection member may comprise a port cover. The selection member may comprise a sleeve, such as a retractable or extendable sleeve. The selection member may comprise a valve, such as a configurable valve.

Alternatively, the selection member may be configured to restrict or prevent fluid communication through the first chamber external port in the second configuration such that fluid pressure in the first fluid chamber varies between external fluid pressure in the first configuration and internal fluid pressure in the second configuration.

The first fluid area may allow external fluid and/or pressure to enter and/or exit the first fluid chamber when the tool is in the first configuration.

The first fluid chamber may be or comprise or be configured to exposed or subjected to external pressure when the tool is in the first configuration. Fluid pressure in the first fluid chamber may be substantially the same as external fluid pressure when the tool is in the first configuration.

The selection member may be configured to allow fluid flow through the second fluid flow area when the tool is in the second configuration, such as only when the tool is in the second configuration.

The selection member may be configured to substantially increase the second fluid flow area when the tool is transitioned or reconfigured to the second configuration.

The second fluid flow area may be substantially larger than the first fluid flow area, at least when the tool is in the second configuration.

When the tool is in the second configuration, fluid flow from the internal or tool bore may be relatively unrestricted into the first fluid chamber. When the tool is in the second configuration, fluid flow between, such as exiting, the first fluid chamber and external to the tool body, such as the annular volume, may be substantially or relatively restricted or prevented.

When the tool is in the second configuration there may be minimal or zero pressure drop across the second flow area between the internal or tool bore and the first fluid chamber.

When the tool is in the second configuration there may be significant pressure drop across the first flow area between the first fluid chamber and external to the tool body, such as the annular volume.

The first fluid chamber may effectively comprise or be at internal or tool bore pressure when the tool is in the second configuration.

The second fluid chamber port may allow external fluid to enter and/or exit the second fluid chamber.

The second fluid chamber port may allow external pressure to enter and/or exit the second fluid chamber.

The second fluid chamber may be at or comprise external pressure when the tool is in the first and/or second configuration/s.

The first fluid chamber and second fluid chamber may define the pressure differential across the second sealing area.

The first fluid chamber and the second fluid chamber may both comprise or be at external pressure when the tool is in the first configuration.

The second sealing area may be subject to zero or marginal pressure differential when the tool is in the first configuration.

The activation piston may be subject to negligible force generated from the second sealing area when the tool is in the first configuration.

The internal or tool bore pressure and the first fluid chamber pressure may define the pressure differential across the first sealing area.

The first fluid chamber may comprise or be at external pressure when the tool is in the first configuration.

The first sealing area may be subject to a pressure differential between the internal or tool bore pressure and the external pressure when the tool is in the first configuration.

When the tool is in the first configuration and subject to the first pressure condition, the activation piston may be subject to a force generated from the first sealing area acting in the second direction.

The internal or tool bore pressure and the second fluid chamber pressure may define a pressure differential across the third sealing area.

The second fluid chamber may comprise or be at external fluid pressure.

When the tool is in the first configuration and subject to the first pressure condition, the activation piston may be subject to a force generated from the third sealing area acting in the first direction.

When the tool is in the first configuration, the activation piston may be subject to a force generated from the first sealing area acting in the second direction and from the third sealing area acting in the first direction. When the tool is in the first configuration, the activation piston may be subject to zero or negligible force generated from the second sealing area. The first and third sealing areas may be of equal area or marginally different in area, acting in opposing direction. The tool may be configured such that the forces generated from the first and third sealing areas are substantially balanced, at least in the first configuration.

When the tool is in the first configuration the activation piston generates zero force or marginal force due to the pressure differential between the internal or tool bore pressure and pressure external to tool body. In the first configuration, a variation in the pressure differential between the internal or toolbore pressure and the external pressure has no substantial variation on the force generated by the activation piston. The tool may be configured to maintain the force generated by the activation piston in the first configuration irrespective of variations in the internal and/or external pressure/s. The maintained force generated may be substantially zero.

The first fluid chamber pressure and the second fluid chamber pressure may define the pressure differential across the second sealing area.

The first fluid chamber may comprise or be at internal or tool bore pressure when the tool is in the second configuration.

The second fluid chamber may comprise or be at external pressure when the tool is in the second configuration.

When the tool is in the second configuration and subject to the first pressure condition, the second sealing area may be subject to the pressure differential between the internal or tool bore pressure and pressure external to the tool body.

When the tool is in the second configuration and subject to the first pressure condition, the activation piston may be subject to a force generated from the second sealing area acting in the second direction.

The internal or tool bore pressure and the first fluid chamber pressure may define the pressure differential across the first sealing area.

The first fluid chamber may effectively comprise or be at tool bore pressure when the tool is in the second configuration.

The first sealing area may be subject to zero or minimal pressure differential when the tool is in the second configuration.

When the tool is in the second configuration and subject to the first pressure condition, the activation piston may be subject to zero or negligible force generated from the first sealing area.

The internal or tool bore pressure and the second fluid chamber pressure may define the pressure differential across the third sealing area.

The second fluid chamber may comprise or be at external fluid pressure.

When the tool is in the second configuration and subject to the first pressure condition, the activation piston may be subject to a force generated from the third sealing area acting in the first direction.

When the tool is in the second configuration and subject to the first pressure condition, the activation piston may be subject to a force generated from the second sealing area acting in the second direction. When the tool is in the second configuration and subject to the first pressure condition, the activation piston may be subject to a force generated from the third sealing area acting in the first direction. When the tool is in the second configuration and subject to the first pressure condition, the activation piston may be subject to zero or negligible force generated from the first sealing area. The second sealing area may be substantially larger than the third sealing area. Accordingly, when the tool is in the second configuration and subject to the first pressure condition, the second sealing area may generate a net activation piston force acting in the second direction.

When the tool is in the second configuration and subject to the first pressure condition, the activation piston may generate a force acting in the second direction.

When the tool is in the first configuration and subject to the first pressure condition, the activation piston may generate a zero force or marginal force.

The under-reamer tool may comprise a third fluid chamber.

The tool body may comprise a port communicating external fluid and/or fluid pressure to the third fluid chamber, such as a third fluid chamber port.

The third fluid chamber port may allow external fluid to enter and/or exit the third fluid chamber.

The third fluid chamber port may allow external pressure to enter and/or exit the third fluid chamber.

The third fluid chamber may comprise or be at external pressure when the tool is in the first and/or second configuration/s.

The retraction piston may comprise or be operatively associated with a (fourth) sealing area between the internal or tool bore and the third fluid chamber.

The retraction piston may comprise or be operatively associated with a (fifth) sealing area between the internal or tool bore and the third fluid chamber.

The fourth sealing area and the fifth sealing area may be located at opposing ends of the third fluid chamber. Accordingly, when the third fluid chamber is exposed to a pressure the fourth and fifth sealing areas may generate opposing forces on the retraction piston.

The fourth sealing area, when subject to the first pressure condition, may result in a net force on the retraction piston (due to the pressure differential across the fourth sealing area) that acts in the first direction. Accordingly, the fourth sealing area may act to retract or maintain retraction of the cutters.

The fifth sealing area, when subject to the first pressure condition, may result in a net force on the retraction piston (due to the pressure differential across the fifth sealing area) that acts in the second direction. Accordingly, the fifth sealing area may act to extend or maintain extension of the cutters.

The fourth sealing area may be substantially larger than the fifth sealing area. Accordingly, when subject to the first pressure condition, the retraction piston may act with a net force in the first direction. Accordingly, the retraction piston may act to retract or maintain retraction of the cutters when subject to the first pressure condition.

The activation piston and the retraction piston may be configured within the under-reamer tool such that they act in opposition, such as in opposing axial directions. The activation piston and the retraction piston may be configured within the under-reamer tool such that they act directly against each other. The activation piston and the retraction piston may be configured within the under-reamer tool such that they act indirectly against each other.

The retraction and activation pistons may be operatively disengaged and/or disengageable. The retraction and activation pistons may be operatively disconnected in at one or more of the first and/or second configuration/s and/or when the cutters are extend and/or retracted. The retraction and activation pistons may configured to indirectly and/or releasably engage each other.

The activation piston and the retraction piston may not be attached or secured to each other. The activation piston and the retraction piston may be connected, such as contacting loosely (e.g. with opposing end faces).

Alternatively, the activation piston and the retraction piston may be secured to each other, such as by a threaded connection. The retraction and activation pistons may configured to directly and/or non-releasably engage each other.

When the tool is in the first configuration and subject to the first pressure condition, the activation piston may generate zero force or marginal force (in either direction).

When the tool is in the first configuration and subject to the first pressure condition, the retraction piston may act with a force in the first direction. When the tool is in the first configuration and subject to the first pressure condition, the retraction piston may act to retract and/or maintain retraction of the cutters. When the tool is in the first configuration and subject to the first pressure condition, the retraction piston may act against the activation piston with opposing force. The retraction piston force may be greater than the activation piston force. Accordingly, in the first configuration, the retraction piston force and the activation piston force may result in a net force such that the retraction piston drives the activation piston toward the first direction, such as to retract or maintain retraction of the cutters.

When the tool is in the second configuration and subject to the first pressure condition, the activation piston may act with a force in the second direction. When the tool is in the second configuration and subject to the first pressure condition, the activation piston may act to extend or maintain extension of the cutters.

When the tool is in the second configuration and subject to the first pressure condition, the retraction piston may act in the first direction with less force than the activation piston acting in the second direction.

When the tool is in the second configuration and subject to the first pressure condition, the activation piston may act, such as acting directly, against the retraction piston with opposing force. When the tool is in the second configuration and subject to the first pressure condition, the activation piston force may be substantially greater than the retraction piston force. When the tool is in the second configuration and subject to the first pressure condition, the relative retraction and activation piston forces may result in a net force driving the activation piston in or towards the second direction. Accordingly, when the tool is in the second configuration and subject to the first pressure condition, the activation piston may extend or maintain extension of the cutters.

The under-reamer tool may comprise a mechanical biasing member. The mechanical biasing member may act between the under-reamer tool body and the activation piston.

The mechanical biasing member may be configured to act against the activation piston acting in the first direction. The mechanical biasing member may be configured to act in the second direction. The mechanical biasing member may be configured to bias the activation piston against cutter extension. The mechanical biasing member may be configured to bias the tool towards cutter retraction.

When the tool is in the first and/or second configuration/s and subject to the third pressure condition, the mechanical biasing member may act with a force, such as a dominant or determinant force, against the activation piston acting in the first direction. When the tool is subject to the third pressure condition, the biasing member may bias and/or drive the cutters to the retracted position. When the tool is in the first and/or second configuration/s and subject to the third pressure condition, the mechanical biasing member may act with or provide a force, such as a dominant or determinant force, such that the cutters are and/or remain retracted.

The mechanical biasing member may comprise one or more of: a spring, a helical spring, a Belleville washer, a resilient member, and/or the like. The mechanical biasing member may comprise a compressive biasing member (e.g. a compression spring). Alternatively, the mechanical biasing member may comprise a tensile biasing member (e.g. a tension spring).

When subject to the second pressure condition, the pistons may act in reverse directions relative to the first pressure condition (e.g. due to tool bore pressure and external annular pressure switching polarity compared to the first pressure condition).

When the tool is in the first configuration and subject to the second pressure condition, the activation piston may generate zero force or marginal force in either direction.

When the tool is in the first configuration and subject to the second pressure condition, the retraction piston may act with substantial force in the second direction. When the tool is in the first configuration and subject to the second pressure condition, the retraction piston may act with substantial force in the direction of cutter blade extension.

When the tool is in the first configuration and subject to the second pressure condition, the activation piston and the retraction piston may be configured to act individually or independently from each other.

The tool may be configured to prevent or at least inhibit that the cutters are driven unintentionally to the extended position.

When the tool is in the first configuration and subject to the second pressure condition the activation piston may generate zero force or marginal force in either direction. The activation piston may be configured as a separate component or device, such as separate from the retraction piston. The mechanical biasing member may act against the activation piston, such as to supply a substantial force acting to drive the activation piston to the first direction (e.g. mechanical biasing member may directly drive the actuation piston towards the direction of retraction).

When the tool is in the first configuration and subject to the second pressure condition, the retraction piston may act with a substantial force in the direction of cutter extension. When the tool is in the first configuration and subject to the second pressure condition, the retraction piston may transfer no force, such as directly, to the activation piston. The retraction piston may be configured as a separate component or device, such as separate from the activation piston.

Accordingly, the tool of the present invention may be configurable to prevent extension of the of the exendable member/s when the tool is subject to the second pressure condition, such as when the tool is in the first configuration. Such a configuration or (re)configurability may be advantageous over other tools that may otherwise be prone to unintended or undesired extension of members when a piston acts in an opposite direction, such as due to a differential pressure other than intended or desired (e.g. a higher annular pressure and/or a lower toolbore pressure).

When the tool is in the first configuration and subject to the second pressure condition the retraction piston may be biased and/or translate axially away from the activation piston.

When the tool is in the first configuration and subject to the second pressure condition, the activation piston may require or receive assistance from the mechanical biasing member to act in the intended direction of cutter retraction. The retraction and/or maintenance of retraction, such as with the aid of the mechanical biasing member, may be supplemented or improved further by the inclusion of the third piston. The third piston may be configured to prevent extension of the cutters when the tool is in the second configuration. The third piston may be configured to bias and/or drive the activation piston in the first direction. The third piston may only be active, or only actively hydraulically biasing, when the tool is subject to the second pressure condition. The third piston may be configured to act or to transmit force to the activation piston and/or retraction piston only when the tool is subject to the second pressure condition. The third piston may be configured to transmit force to the activation piston and/or retraction piston only when the tool is subject to the second pressure condition, such as to transmit hydraulically-generated force to the activation piston and/or retraction piston only when the tool is subject to the second pressure condition.

The conditional piston may be configured to exert a bias in a substantially opposite direction to the retraction piston. The conditional piston may be configured to exert a different magnitude of bias than the retraction piston. The conditional piston may be configured to exert a larger bias force than the retraction piston. The conditional piston may be configured to exert a smaller bias force than the retraction piston. The retraction piston may be configured to resist movement of the activation member in a first direction (e.g. uphole or downhole). The conditional piston may be configured to resist movement of the activation member in a second direction (e.g. downhole or uphole). The first and second directions may be substantially opposite. The direction of resistance may be dependent upon the pressure condition and/or the configuration of the tool.

The tool may comprise a fourth fluid chamber. The fourth fluid chamber may be an internal chamber.

The tool may comprise a port or a plurality of ports communicating internal or tool bore pressure to the fourth fluid chamber.

The fourth fluid chamber may be positioned or located within the tool, such as between the second fluid chamber and the third fluid chamber. The fourth fluid chamber may be located on an opposite axial side of the third piston. The third piston may divide an internal volume, such as a cylinder, into the third and fourth chambers. The third piston may be configured to be subject to a pressure differential between the third and fourth chambers.

An external diameter of the conditional piston may locate against an internal diameter of the tool body.

Alternatively an additional component, such as a cartridge case, may be located between the external diameter of the conditional piston and the internal diameter of the tool body.

The internal diameter of the conditional piston may locate against an external diameter of the retraction piston. The internal diameter of the conditional piston may define the fifth sealing area. The internal diameter of the conditional piston may locate on the external diameter of the retraction piston which defines the fifth sealing area.

The tool may comprise an axial stop, such as an axial end stop between the retraction and conditional pistons. The retraction piston may comprise a boss, flange, shoulder or protrusion at the far end of the fifth sealing area shaft. The boss, flange or protrusion may form the distal axial end stop between the retraction piston and the conditional piston.

The outer diameter of the conditional piston may locate on an internal bore of the tool body. The tool may comprise a stop between the conditional piston and the tool body. A face or protrusion configured to engage the conditional piston, such as at the external diameter of the conditional piston (e.g. at the end of the bore on the tool body or the additional component, such as the cartridge case), may form a distal axial end stop between the conditional piston and the tool body.

The conditional piston may slide axially along or within the tool between the distal end stop on the retraction piston and the distal end stop on the tool body.

The outer diameter of the conditional piston may define the sixth sealing area.

The conditional piston may be positioned, within the tool, between the third fluid chamber and the fourth fluid chamber such that one end face of the conditional piston is subject to annular pressure from the third fluid chamber and the opposite end face of the conditional piston is subject to internal or tool bore pressure from the fourth fluid chamber, in the first and/or second configurations.

The mechanical biasing member may be located within the third fluid chamber. The mechanical biasing member may be located between the conditional piston and the tool body bore, such as axially located between an end face of the conditional piston and an end face of the tool body bore or an end face of a cartridge case located inside the tool body bore.

The mechanical biasing member may act between an end face on the main tool body and an end face of the conditional piston applying force to locate the conditional piston against the distal axial end stop on the retraction piston.

The mechanical biasing member may apply a force on the conditional piston to act in the first direction. The mechanical biasing member may be configured to bias the conditional piston towards the direction of cutter retraction.

The cartridge case component may be mounted within the under-reamer such that it is secured axially within the main tool body. Load transferred from the retraction piston and/or the conditional piston and/or the mechanical biasing member to any end face on the cartridge case may be transferred through the cartridge case component to the main tool body.

The tool may comprise a retraction module. The retraction module may comprise the retraction piston, the conditional piston and the mechanical biasing member. The cartridge case may be used to house the retraction piston, conditional piston and mechanical biasing member as an assembly or sub assembly, which may be defined as the retraction module.

The retraction module may provide a fluid communication path between external fluid (e.g. annular fluid), such as from the third fluid chamber port, and a fluid chamber within the retraction module, such as the third fluid chamber.

The retraction module may be housed within the tool body such that the cartridge case is restrained from axial movement within the tool body. The retraction module may be housed within the tool body such that axial movement of the retraction piston and/or the conditional piston is allowed.

The retraction piston may be free to move, within the tool body, between two axial distal stops. Load exerted from the retraction piston may be transferred to the tool body through either axial distal stop.

The conditional piston may be free to move in the second direction to a tool body distal stop. Load may be transferred from the conditional piston to the tool body, such as through the axial stop.

The conditional piston may be free to move in the first direction to a distal stop located on the retraction piston. Load may be transferred from the conditional piston to the retraction piston, such as through the distal stop on the retraction piston.

The mechanical biasing member may be configured to supply force on the conditional piston acting in the first direction, such as transferring load through the conditional piston to the distal stop on the retraction piston.

When subject to the first pressure condition, the retraction piston may act in the first direction with significant force.

When subject to the first pressure condition, the conditional piston may act in the second direction acting, such as directly, against the mechanical biasing member. When subject to the first pressure condition, the conditional piston may have sufficient force to overcome the mechanical biasing member. Accordingly, when subject to the first pressure condition, the conditional piston may translate axially to the distal end stop, thus transferring load through to the tool body.

When subject to the first pressure condition, the conditional piston may move in an opposing axial direction to the retraction piston. When subject to the first pressure condition, zero force may be exchanged between the conditional piston and the retraction piston.

When subject to the second pressure condition, the retraction piston may act in the second direction.

When subject to the second pressure condition, the conditional piston may act in the first direction.

When subject to the second pressure condition, the conditional piston may act, such as directly act, against the retraction piston. The conditional piston may act with greater force than the retraction piston. Accordingly, the conditional piston may bias and/or drive the retraction piston in or towards the first direction.

When subject to the third pressure condition, both the retraction piston and conditional piston may act with zero force due to zero pressure differential between the internal or tool bore pressure and the pressure external to the tool body.

When subject to the third pressure condition, the mechanical biasing member may act on, such as dominantly act on, the conditional piston. In turn, the conditional piston may acts against and supply a substantial force for the retraction piston to act in the first direction.

The retraction piston may act in or towards the first direction when subject to any of the first pressure condition, the second pressure condition or the third pressure condition.

The retraction piston may act in or towards the first direction when the internal or tool bore pressure is greater than the pressure external to tool body, such as annular pressure.

The retraction piston may act in or towards the first direction when the pressure external to tool body, such as annular pressure, is greater than the internal or tool bore pressure.

The retraction piston may act in or towards the first direction when the internal or tool bore pressure equals the pressure external to the tool body, such as annular pressure.

The retraction piston may act in or towards the first direction in the first and/or second tool configurations, such as for all pressure conditions.

The tool may comprise the configurable activation piston and the retraction module. The configurable activation piston may act, such as directly, against the retraction module.

The activation piston may loosely contact the retraction module, such as by adjacent end faces.

Alternatively, the activation piston may be secured to the retraction module, such as by a threaded connection.

When the tool is in the first configuration and subject to the first pressure condition, the activation piston may act with zero force or marginal force. When the tool is in the first configuration and subject to the first pressure condition, the retraction module may act in the first direction with a substantial or dominant force. When the tool is in the first configuration and subject to the first pressure condition, the activation piston may be driven and/or biased by the retraction module to act in the first direction with a substantial or dominant force.

When the tool is in the first configuration and subject to the first pressure condition, the cutters may be driven and/or biased to the retracted position with the substantial or dominant force.

When the tool is in the first configuration and subject to the second pressure condition, the activation piston may act with zero or marginal force. When the tool is in the first configuration and subject to the second pressure condition, the retraction module may act in the first direction with a substantial or dominant force. When the tool is in the first configuration and subject to the second pressure condition, the activation piston may be driven and/or biased by the retraction module to act in the first direction, such as with the substantial or dominant force.

When the tool is in the first configuration and subject to the second pressure condition, the cutters may be driven and/or biased to the retracted position, such as with the substantial or dominant force.

When the tool is in the first configuration and subject to the third pressure condition, the activation piston and the retraction module may generate zero or marginal force. The mechanical biasing member may drive and/or bias the retraction module and the activation piston to act in the first direction with a substantial or dominant force.

When the tool is in the first configuration and subject to the third pressure condition, the cutters may be driven and/or biased to the retracted position with a substantial or dominant force.

When the tool is in the second configuration and subject to the first pressure condition, the activation piston may act in the second direction, such as with a significant force. When the tool is in the second configuration and subject to the first pressure condition, the retraction module may act in the first direction with substantially less force than the activation piston acting in the second direction. When the tool is in the second configuration and subject to the first pressure condition, the activation piston may generate a substantially greater force than the retraction module. Accordingly, when the tool is in the second configuration and subject to the first pressure condition, the activation piston may act in the second direction, such as with a significant force.

When the tool is in the second configuration and subject to the first pressure condition, the cutters may be driven to the extended position, such as with a substantial or dominant force.

When the tool is in the second configuration and subject to the second pressure condition, the activation piston may act in the first direction, such as with a significant force. When the tool is in the second configuration and subject to the second pressure condition, the retraction module may act with in the first direction, such as with a significant force. Accordingly, when the tool is in the second configuration and subject to the second pressure condition, the activation piston may act in the first direction with a combined force of the activation piston and the retraction module.

When the tool is in the second configuration and subject to the second pressure condition, the cutters may be driven and/or biased to the retracted position, such as with a significant force.

When the tool is in the second configuration and subject to the third pressure condition, the activation piston and the retraction module may generate zero or marginal force (e.g. due to a lack of pressure differentials). When the tool is in the second configuration and subject to the third pressure condition, the mechanical biasing member may act against the activation piston, driving the activation piston to act in the first direction, such as with significant force.

When the tool is in the second configuration and subject to the third pressure condition, the cutters may be driven and/or biased to the retracted position, such as with significant force.

When the tool is in the first configuration, the cutter blades may be driven to the retracted position regardless of any pressure differential polarity between the internal or tool bore pressure and the pressure external to tool body, such as annular pressure.

When the tool is in the first configuration, the cutters may be driven to the retracted position regardless of any pressure differential magnitude between the internal or tool bore pressure and the pressure external to tool body, such as annular pressure.

When the tool is in the first configuration, a retraction force may be increased or maximised, such as by increasing the pressure differential (e.g. between a relatively high internal or tool bore pressure and a relatively low pressure external to tool body, such as annular pressure).

When the tool is in the first configuration, the retraction force may be increased or maximised, such as by increasing a fluid flow rate through the tool bore.

When the tool is in the second configuration, the cutters may be driven and/or biased to the extended position only when the internal or tool bore pressure is greater than the pressure external to tool body, such as annular pressure.

When the tool is in the second configuration, the cutters may be driven and/or biased to the extended position only when the internal or tool bore pressure is greater than the external or annular pressure and with sufficient net force to overcome the mechanical biasing member.

When the tool is in the second configuration and subject to the first pressure condition, the conditional piston may act, such as directly, against the mechanical biasing member. The conditional piston may act independently from the activation piston.

When subject to the first pressure condition, the conditional piston may counteract or overcome the mechanical biasing force. When the tool is in the second configuration and subject to the first pressure condition, the conditional piston may reduce or eliminate or negate the mechanical biasing member force acting against the activation piston. Accordingly, when the tool is in the second configuration and subject to the first pressure condition, the conditional piston may effectively increase the net activation piston force.

The activation piston may be configured to provide a negligible or no axial bias when not selected or activated, such as in the first configuration. The activation piston may be configured to provide a bias when selected or activated. The activation piston may be configured to provide an uphole (or alternatively downhole) bias when selected. The activation piston may be configured to provide a bias when selected, such as in the second configuration, according to an operation parameter, such as a fluid differential (e.g. between the internal or toolbore pressure and the external or annular pressure). The activation piston may be configured to selectively provide either of a bias or a negligible bias in the second configuration according to an operation parameter.

The tool may be configured to expose at least a portion of the activation piston to a fluid pressure differential only in the second configuration. The tool may be configured to prevent or at least limit exposure of the activation piston to a pressure differential in the first configuration. The tool may be configured to expose the at least a portion of the activation piston to a pressure differential in the second configuration. The under-reaming tool may be configured to expose the at least a portion of the activation piston to a pressure differential between an internal fluid pressure and the external fluid pressure (only) in the second configuration. The tool may be configured to allow the activation piston to move between an inactive position with the cutters retracted and an activated position with the cutters extended only in the second configuration. The tool may be configured to allow selection or activation of the activation member by selectively exposing the at least a portion of the activation member to the fluid pressure differential. The tool may be reconfigured between the first configuration and the second configuration by selectively exposing the at least a portion of the activation piston to the fluid pressure differential. Accordingly, the activation and retraction pistons may be controlled to provide a net bias in alternate directions dependent upon the pressure condition, at least when the tool is in the second configuration.

The tool may comprise a control mechanism configurable to prevent cycling between the first and second configurations and thus maintain the tool in a selected one of the first and second configurations. The control mechanism may comprise the selection member.

One of several methods of controlling the cycling may be used. For example, the configuration of the tool may be controlled using an indexer, such as actuated by flow rate cycles through the tool and/or a drop-ball/s and/or an electronic shifting mechanism and/or a fluid flow activated mechanism. The configuration of the tool may additionally or alternatively by controlled using an electric motor triggered by a signal. The signal may be sent to the tool via any telemetry method, including the telemetry method based on detection of drill string rotation, such as disclosed in U.S. patent application Ser. No. 61/803,696 assigned to the assignee of the present invention, the disclosure of which is incorporated herein by reference.

According to a further aspect of the invention, there is provided a downhole tool comprising:

a body; and an activation member at least partially located within the body;

wherein the tool is configured to selectively vary an effective sealing area of the activation member to selectively vary a hydraulic bias of the activation member.

Providing such a downhole tool wherein the tool is configured to selectively vary an effective sealing area of the activation member to selectively vary a hydraulic bias of the activation member may permit the activation member to exert a selective force as a result of a fluid pressure. Such a downhole tool may permit a movement of the activation member as a result of the fluid pressure, such as an activating or deactivating movement.

The effective sealing area may be an effective cross-sectional sealing area. For example, the tool may further comprise a first seal defining a first cross-sectional sealing area perpendicular to a longitudinal axis of the activation member. The first seal may encompass the first sealing area.

The tool may be configured to selectively vary a magnitude of the hydraulic bias.

The tool may be configured to selectively vary a direction of the hydraulic bias.

The hydraulic bias may be a substantially axial bias. For example, the hydraulic bias may be towards a first axial direction.

The tool may be configured to selectively vary the hydraulic bias of the activation member without a substantial variation in an internal body fluid pressure, such as a toolbore pressure. The tool may be configured to selectively vary the hydraulic bias of the activation member at substantially the same internal body fluid pressure.

The tool may further comprise a second seal, wherein the tool is configured to selectively vary an effective sealing area of the activation member by selectively transferring effective sealing of the activation member from the first seal to the second seal.

The first seal may provide an effective seal between the activation member and the body in a first configuration, and the second seal may provide an effective seal between the activation member and the body in a second configuration.

The first seal may inhibit fluid communication between the internal body fluid and the second seal in the first configuration. The first seal may prevent fluid communication between the internal body fluid and the second seal in the first configuration. The first seal may permit a partial fluid communication between the internal body fluid and the second seal in the first configuration.

In the first configuration, there may be an effective pressure differential across the first seal and in the second configuration there may be an ineffective pressure differential across the first seal. In the first configuration, there may be an ineffective pressure differential across the second seal and in the second configuration there may be an effective pressure differential across the second seal.

The ineffective pressure differential may be substantially no pressure differential.

The ineffective pressure differential may be relatively small.

The tool may be configured to fluidly communicate the second seal with the internal body fluid via a first fluid chamber, such as a first fluid passage.

The tool may be configured to selectively vary fluid pressure in the first fluid chamber. For example, the tool may comprise at least a first flow restriction, such as a first port, between the second seal and the internal body fluid, such as between the first fluid chamber and a fluid supply in a body internal bore. In the first configuration the first flow restriction may inhibit fluid communication between the internal body fluid and the first fluid chamber more, relative to the first flow restriction in the second configuration. For example, the first flow restriction may comprise a relatively small opening in the first configuration, compared to a relatively large opening in the second configuration.

The tool may be configured to generate a greater pressure differential across the first flow restriction in the first configuration than in the second configuration. The tool may be configured to generate a greater pressure differential across the first flow restriction in the first configuration than in the second configuration.

A pressure in the first fluid chamber may be substantially less than the internal body fluid pressure in the first configuration, at least when subject to the first pressure condition.

A pressure in the first fluid chamber may be substantially the same as the internal body fluid pressure in the first configuration, at least when subject to the third pressure condition.

A pressure in the first fluid chamber may be substantially more than the internal body fluid pressure in the first configuration, at least when subject to the second pressure condition.

A pressure in the first fluid chamber may be substantially the same as the internal body fluid pressure in the second configuration, when subject to the first and/or second and/or third pressure conditions.

Alternatively, the pressure in the first fluid chamber may be substantially less than the internal body fluid pressure in the second configuration, when subject to the first and/or second and/or third pressure conditions.

Further alternatively, pressure in the first fluid chamber may be substantially more than the internal body fluid pressure in the second configuration, when subject to the first and/or second and/or third pressure conditions.

The first flow restriction may substantially limit fluid communication between the first fluid chamber and the internal body fluid in the first configuration.

The first flow restriction may substantially prevent fluid communication between the first fluid chamber and the internal body fluid in the first configuration.

The first flow restriction may be effectively negated in the second configuration. For example, there may be substantially no pressure differential across the first flow restriction in the second configuration.

The first fluid chamber may be in substantially unrestricted fluid communication with the internal body fluid in the second configuration.

The first flow restriction may be altered during the transformation of the tool from the first configuration to the second configuration. For example, the first flow restriction may be opened, or enlarged, as the tool transitions from the first configuration to the second configuration.

The first flow restriction may be effectively bypassed in the second configuration. For example the tool may further comprise a first flow restriction bypass, the bypass configured to be substantially closed in the first configuration and substantially open in the second configuration.

The tool may comprise a first cross-sectional flow area between the internal body fluid and the first fluid chamber in the first configuration; and a second cross-sectional flow area between the internal body fluid and the first fluid chamber in the second configuration. The first cross-sectional flow area may be substantially smaller than the second cross-sectional flow area. For example, the tool may comprise at least a second flow restriction, such as a second port, between the first fluid chamber and the internal body fluid. In the first configuration the second flow restriction may inhibit fluid communication between the internal body fluid and the first fluid chamber more, relative to the second flow restriction in the second configuration. For example, the second flow restriction may be substantially closed in the first configuration.

The tool may further comprise a first chamber external port between the first fluid chamber and a body exterior, such as an annulus between the body and a bore. The first chamber external port may provide fluid communication between The tool may comprise a fourth seal. The fourth seal may provide for a hydraulic counterbias. For example, the fourth seal may provide for a fourth sealing area, such as a fourth cross-sectional sealing area.

The hydraulic counterbias may act in the opposite direction to the hydraulic bias.

The hydraulic counterbias may act in the same direction as the hydraulic bias.

The hydraulic counterbias may act in the opposite direction to the hydraulic bias in the first configuration.

The hydraulic counterbias may act in the opposite direction to the hydraulic bias in the second configuration.

The hydraulic counterbias may act in the same direction as the hydraulic bias in the first configuration.

The hydraulic counterbias may act in the same direction as the hydraulic bias in the second configuration.

The hydraulic counterbias may be greater than the hydraulic bias.

The hydraulic counterbias may be less than the hydraulic bias.

The hydraulic counterbias may be greater than the hydraulic bias in the first configuration.

The hydraulic counterbias may be less than the hydraulic bias in the second configuration.

The hydraulic counterbias may be less than the hydraulic bias in the first configuration.

The hydraulic counterbias may be greater than the hydraulic bias in the second configuration.

The tool may be configured to exert a net hydraulic force on the activation member.

The net hydraulic force may comprise the hydraulic bias.

The net hydraulic force may comprise the hydraulic counterbias.

The tool may further comprise a mechanical biasing member. For example, the tool may further comprise a spring. The mechanical biasing member may be configured to provide a mechanical force in a same direction as the net hydraulic force.

The mechanical biasing member may be configured to provide a mechanical force in an opposite direction to the net hydraulic force.

The mechanical biasing member may be configured to provide a greater force than the net hydraulic force.

The mechanical biasing member may be configured to provide a lesser force than the net hydraulic force.

The mechanical biasing member may be configured to provide a greater force than the net hydraulic force in the first configuration.

The mechanical biasing member may be configured to provide a lesser force than the net hydraulic force in the first configuration.

The mechanical biasing member may be configured to provide a lesser force than the net hydraulic bias in the first configuration.

The mechanical biasing member may be configured to provide a greater force than the net hydraulic force in the first configuration.

The tool may be configured for multiple reconfiguration downhole.

The tool may be configured to selectively cycle between the first and second configurations.

The tool may comprise a first or an activation piston. For example, the activation member may comprise a shaft, such as a hollow shaft, configured for axial movement within the body. The activation piston may be a fluid-actuated piston.

The first seal may be an annular seal. The second seal may be an annular seal. The third seal may be an annular seal. The fourth seal may be an annular seal.

The tool may comprise a reamer. The tool may comprise an underreamer. The tool may comprise a drillbit. The tool may comprise an injector, such as an acidifying injector.

The activation member may permit the passage of fluid through the tool in multiple configurations, such as in an active and an inactive configuration.

According to a further aspect of the invention, there is provided a downhole tool comprising:

a body; and an activation member at least partially located within the body;

wherein the tool is configured to selectively vary an effective sealing area of the activation member to selectively vary a hydraulic bias of the activation member.

Providing such a downhole tool wherein the tool is configured to selectively vary an effective sealing area of the activation member to selectively vary a hydraulic bias of the activation member may permit the activation member to exert a selective force as a result of a fluid pressure. Such a downhole tool may permit a movement of the activation member as a result of the fluid pressure, such as an activating or deactivating movement.

The effective sealing area may be an effective cross-sectional sealing area. For example, the tool may further comprise a first seal defining a first cross-sectional sealing area perpendicular to a longitudinal axis of the activation member. The first seal may encompass the first sealing area.

The tool may be configured to selectively vary a magnitude of the hydraulic bias.

The tool may be configured to selectively vary a direction of the hydraulic bias.

The hydraulic bias may be a substantially axial bias. For example, the hydraulic bias may be towards a first axial direction.

The tool may be configured to selectively vary the hydraulic bias of the activation member without a substantial variation in an internal body fluid pressure, such as a toolbore pressure. The tool may be configured to selectively vary the hydraulic bias of the activation member at substantially the same internal body fluid pressure.

The tool may further comprise a second seal, wherein the tool is configured to selectively vary an effective sealing area of the activation member by selectively transferring effective sealing of the activation member from the first seal to the second seal.

The first seal may provide an effective seal between the activation member and the body in a first configuration, and the second seal may provide an effective seal between the activation member and the body in a second configuration.

The first seal may inhibit fluid communication between the internal body fluid and the second seal in the first configuration. The first seal may prevent fluid communication between the internal body fluid and the second seal in the first configuration. The first seal may permit a partial fluid communication between the internal body fluid and the second seal in the first configuration.

In the first configuration, there may be an effective pressure differential across the first seal and in the second configuration there may be an ineffective pressure differential across the first seal. In the first configuration, there may be an ineffective pressure differential across the second seal and in the second configuration there may be an effective pressure differential across the second seal.

The ineffective pressure differential may be substantially no pressure differential.

The ineffective pressure differential may be relatively small.

The tool may be configured to fluidly communicate the second seal with the internal body fluid via a first fluid chamber, such as a first fluid passage.

The tool may be configured to selectively vary fluid pressure in the first fluid chamber. For example, the tool may comprise at least a first flow restriction, such as a first port, between the second seal and the internal body fluid, such as between the first fluid chamber and a fluid supply in a body internal bore. In the first configuration the first flow restriction may inhibit fluid communication between the internal body fluid and the first fluid chamber more, relative to the first flow restriction in the second configuration. For example, the first flow restriction may comprise a relatively small opening in the first configuration, compared to a relatively large opening in the second configuration. The first flow restriction may be effectively closed in the first configuration such that there is no opening in the first configuration.

The tool may be configured to generate a greater pressure differential across the first flow restriction in the first configuration than in the second configuration.

A pressure in the first fluid chamber may be substantially less than the internal body fluid pressure in the first configuration.

A pressure in the first fluid chamber may be substantially the same as the internal body fluid pressure in the first configuration.

A pressure in the first fluid chamber may be substantially more than the internal body fluid pressure in the first configuration.

A pressure in the first fluid chamber may be substantially less than the internal body fluid pressure in the second configuration.

A pressure in the first fluid chamber may be substantially the same as the internal body fluid pressure in the second configuration.

A pressure in the first fluid chamber may be substantially more than the internal body fluid pressure in the second configuration.

A pressure in the first fluid chamber may be substantially less than the internal body fluid pressure in the first configuration.

A pressure in the first fluid chamber may be substantially the same as the internal body fluid pressure in the first configuration.

A pressure in the first fluid chamber may be substantially more than the internal body fluid pressure in the first configuration.

A pressure in the first fluid chamber may be substantially less than the internal body fluid pressure in the second configuration.

A pressure in the first fluid chamber may be substantially the same as the internal body fluid pressure in the second configuration.

A pressure in the first fluid chamber may be substantially more than the internal body fluid pressure in the second configuration.

The first flow restriction may substantially limit fluid communication between the first fluid chamber and the internal body fluid in the first configuration.

The first flow restriction may substantially prevent fluid communication between the first fluid chamber and the internal body fluid in the first configuration.

The first flow restriction may be effectively negated in the second configuration. For example, there may be substantially no pressure differential across the first flow restriction in the second configuration.

The first fluid chamber may be in substantially unrestricted fluid communication with the internal body fluid in the second configuration.

The first flow restriction may be altered during the transformation of the tool from the first configuration to the second configuration. For example, the first flow restriction may be opened, or enlarged, as the tool transitions from the first configuration to the second configuration.

The first flow restriction may be effectively bypassed in the second configuration. For example the tool may further comprise a first flow restriction bypass, the bypass configured to be substantially closed in the first configuration and substantially open in the second configuration.

The tool may comprise a first cross-sectional flow area between the internal body fluid and the first fluid chamber in the first configuration; and a second cross-sectional flow area between the internal body fluid and the first fluid chamber in the second configuration. The first cross-sectional flow area may be substantially smaller than the second cross-sectional flow area. For example, the tool may comprise at least a second flow restriction, such as a second port, between the first fluid chamber and the internal body fluid. In the first configuration the second flow restriction may inhibit fluid communication between the internal body fluid and the first fluid chamber more, relative to the second flow restriction in the second configuration. For example, the second flow restriction may be substantially closed in the first configuration.

The tool may further comprise a first chamber external port between the first fluid chamber and a body exterior, such as an annulus between the body and a bore. The first chamber external port may provide fluid communication between The tool may comprise a fourth seal. The fourth seal may provide for a hydraulic counterbias. For example, the fourth seal may provide for a fourth sealing area, such as a third cross-sectional sealing area.

The hydraulic counterbias may act in the opposite direction to the hydraulic bias.

The hydraulic counterbias may act in the same direction as the hydraulic bias.

The hydraulic counterbias may act in the opposite direction to the hydraulic bias in the first configuration.

The hydraulic counterbias may act in the opposite direction to the hydraulic bias in the second configuration.

The hydraulic counterbias may act in the same direction as the hydraulic bias in the first configuration.

The hydraulic counterbias may act in the same direction as the hydraulic bias in the second configuration.

The hydraulic counterbias may be greater than the hydraulic bias.

The hydraulic counterbias may be less than the hydraulic bias.

The hydraulic counterbias may be greater than the hydraulic bias in the first configuration.

The hydraulic counterbias may be less than the hydraulic bias in the second configuration.

The hydraulic counterbias may be less than the hydraulic bias in the first configuration.

The hydraulic counterbias may be greater than the hydraulic bias in the second configuration.

The tool may be configured to exert a net hydraulic force on the activation member.

The net hydraulic force may comprise the hydraulic bias.

The net hydraulic force may comprise the hydraulic counterbias.

The tool may further comprise a mechanical biasing member. For example, the tool may further comprise a spring. The mechanical biasing member may be configured to provide a mechanical force in a same direction as the net hydraulic force.

The mechanical biasing member may be configured to provide a mechanical force in an opposite direction to the net hydraulic force.

The mechanical biasing member may be configured to provide a greater force than the net hydraulic force.

The mechanical biasing member may be configured to provide a lesser force than the net hydraulic force.

The mechanical biasing member may be configured to provide a greater force than the net hydraulic force in the first configuration.

The mechanical biasing member may be configured to provide a lesser force than the net hydraulic force in the first configuration.

The mechanical biasing member may be configured to provide a lesser force than the net hydraulic bias in the first configuration.

The mechanical biasing member may be configured to provide a greater force than the net hydraulic force in the first configuration.

The tool may be configured for multiple reconfiguration downhole.

The tool may be configured to selectively cycle between the first and second configurations.

The tool may comprise a first or an activation piston. For example, the activation member may comprise a shaft, such as a hollow shaft, configured for axial movement within the body. The activation piston may be a fluid-actuated piston.

The first seal may be an annular seal. The second seal may be an annular seal. The third seal may be an annular seal. The fourth seal may be an annular seal.

The tool may comprise a reamer. The tool may comprise an underreamer. The tool may comprise a drillbit. The tool may comprise an injector, such as an acidifying injector.

The activation member may permit the passage of fluid through the tool in multiple configurations, such as in an active and an inactive configuration.

The tool may be configured to compensate for a lower internal body fluid pressure than an external body fluid pressure. For example, the tool may comprise a counterpiston, the counterpiston configured to limit a transition of the activation member from the first configuration to the second configuration when the internal body fluid pressure is less than the external body fluid pressure. The counterpiston may be configured to provide an additional hydraulic counterbias when the internal body fluid pressure is less than the external body fluid pressure.

The tool may comprise at least one radially extendable member mounted to the body. The tool may comprise a cam member operatively associated with the extendable member and movable relative to the body between and movable between retraction and extension positions to extend the extendable member. The activation member may be configured to cycle the cam member between the retraction and extension positions.

According to a further aspect of the present invention, there is provided a downhole tool comprising:

a body;

an activation member;

a first fluid chamber defined between the body and the activation member; and a second fluid chamber defined between the body and the activation member;

wherein the tool is configured to selectively vary pressure in the first fluid chamber between a first fluid pressure and a second fluid pressure to selectively vary a fluid pressure differential between the first fluid chamber and the second fluid chamber to selectively vary a hydraulic bias of the activation member.

The first fluid pressure may be substantially an internal body pressure, such as substantially a tool bore pressure. The first fluid chamber may be configured to be in fluid communication with an internal body fluid. For example, the tool may further comprise a first chamber internal port between the first fluid chamber and a body interior. The first fluid chamber may be configured to be in selective fluid communication with the internal body fluid.

The second fluid pressure may be substantially an external body pressure, such as substantially an annular pressure. The first fluid chamber may be configured to be in fluid communication with an external body fluid. For example, the tool may further comprise a first chamber external port between the first fluid chamber and a body exterior, such as an annulus between the body and a bore. The first fluid chamber may be configured to be in selective fluid communication with the external body fluid.

The second fluid chamber may be configured to be in fluid communication with the external body fluid. For example, the tool may further comprise a second chamber external port between the second fluid chamber and the body exterior, such as an annulus between the body and a bore. The second fluid chamber may be configured to be in selective fluid communication with the external body fluid.

The first configuration may be an inactive configuration. The second configuration may be an active configuration.

According to another aspect of the present invention, there is provided a method of performing a downhole operation comprising:

running a tool comprising radially extendable member into a bore;

activating an activation member to extend the extendable member;

operating the extendable member;

deactivating the activation member to retract the extendable member;

reactivating the activation member to extend the extendable member.

The method may include cycling the activation member between activated and deactivated positions.

The method may comprise under-reaming.

The tool may comprise an under-reamer.

The radially extendable member may comprise a cutter

The method may comprise subjecting the tool to multiple pressure conditions.

A first pressure condition may be defined as tool bore pressure being greater than pressure external to tool body.

A second pressure condition may be defined as pressure external to tool body being greater than tool bore pressure.

A third pressure condition may be defined as tool bore pressure being equal to pressure external to tool body.

According to a further aspect of the present invention, there is provided a method of selectively varying a hydraulic bias of an activation member of a downhole tool, the method comprising:

selectively varying pressure in a first fluid chamber between a first fluid pressure and a second fluid pressure, such that a fluid pressure differential between the first fluid chamber and a second fluid pressure selectively varies the hydraulic bias of the activation member.

The first fluid pressure may be a lower fluid pressure than the second fluid pressure.

The first fluid pressure may be a substantially annular fluid pressure.

The second fluid pressure may be a substantially tool bore pressure.

The method may further comprise selectively varying fluid flow into the first fluid chamber. For example, the method may further comprise selectively substantially altering a first flow restriction between the first fluid chamber and an internal fluid flow, such as an internal bore fluid. For example, the method may further comprise selectively substantially varying the size of a first flow restriction.

The method may further comprise enlarging a first flow restriction from a first configuration to a second configuration. For example, the first flow restriction may be an opening that is substantially closed in the first configuration and substantially opened in the second configuration.

The method may further comprise substantially bypassing the first flow restriction.

The method may further comprise providing a fluid passage into the first fluid chamber.

The method may further comprise selectively varying flow out of the first fluid chamber.

The method may further comprise selectively varying pressure in the second fluid chamber.

The method may further comprise selectively varying fluid flow into the second fluid chamber.

The method may further comprise selectively varying flow out of the second fluid chamber.

According to a further aspect of the invention, there is provided a downhole tool comprising:

a body; and an activation member at least partially located within the body;

wherein the tool is configured to selectively vary an effective sealing area of the activation member upon which a substantially tool bore pressure acts to selectively vary a hydraulic bias of the activation member.

According to a further aspect of the present invention, there is provided a downhole tool comprising:

a body;

an activation member;

a first fluid chamber defined between the body and the activation member; and a second fluid chamber defined between the body and the activation member;

wherein the tool is configured to selectively vary a hydraulic bias of the activation member in a first axial direction by selectively varying a pressure in the first fluid chamber between a substantially tool bore fluid pressure and a substantially annular fluid pressure in order to selectively vary a fluid pressure differential between the first fluid chamber and the second fluid chamber.

According to a further aspect of the present invention, there is provided a downhole tool comprising:

a body;

at least one radially extendable member mounted to the body;

a cam member operatively associated with the extendable member and movable relative to the body between retraction and extension positions to extend the extendable member; and an activation member configured to cycle the cam member between the retraction and extension positions.

Providing such an activation member may permit a cycling of the cam member between the retraction and extension positions, such as the re-extension of the radially extendable member after the extendable member has been retracted from the extended position. This may be useful during a downhole operation in circumstances where the operator wishes to temporarily retract the extendable member, for example where the downhole tool is temporarily pulled a portion of the way through existing casing. In downhole operations, for example where the tool is in the form of an underreamer, the extendable member or members, in the form of cutting blades, are likely to describe a larger diameter than the minimum bore internal diameter above the tool when extended. Accordingly, to retrieve the tool a portion of the way through the existing casing, the blades are retracted. Thus, if the blades cannot be re-extended, the underreaming operation must be ceased and the tool fully retrieved in order to reconfigure the tool for a subsequent run and underreaming operation. Particularly where the downhole operation is located beneath an existing section of casing, the length of the bore entails a lengthy and costly operation to fully retrieve and redeploy a tool. The present invention permits partial retrieval of the tool and subsequent redeployment of the tool without the need to fully retrieve the tool.

Similarly, during retrieval of the tool with the extendable member in the retracted position, the tool may encounter a section of the bore where it is desired to re-ream the section. For example, creep may create a tightspot in an already reamed section. The present invention permits re-reaming during retrieval of the tool. The present invention also permits the planned reaming of multiple sections. For example, two separate sections of bore may be desired to be reamed; typically for the subsequent location of specific apparatus in the reamed locations, such as a joint, a gravel pack or a particular casing section.

The cam member may take any appropriate form, but is preferably axially movable relative to the body to extend and retract the extendable member. Accordingly, the activation member may be axially movable relative to the body to cause axial movement of the cam member relative to the body.

The cam member may be coupled to the extendable member such that axial movement of the cam results in the retraction of the extendable member.

Additionally, or alternatively, the extendable member may be centrally biased. For example, the extendable member may be sprung towards the retracted position.

The extendable member may be radially linearly translatable relative to the body. Additionally, or alternatively, the extendable member may be rotatable relative to the body.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to any of the other aspects, without the need to explicitly and unnecessarily list those various combinations and permutations here. For example, features recited with respect to an apparatus of one aspect may be applicable to an under-reaming tool of another aspect, and vice-versa; and the same applies to an extendable member of one aspect and an extendable cutter of another aspect; or features recited with respect to a piston, such as an activation piston, may be applicable to a member, such as an activation member.

In addition, corresponding means for performing one or more of the discussed functions are also within the present disclosure.

It will be appreciated that one or more embodiments/aspects may be useful in activating a downhole tool.

The above summary is intended to be merely exemplary and non-limiting.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
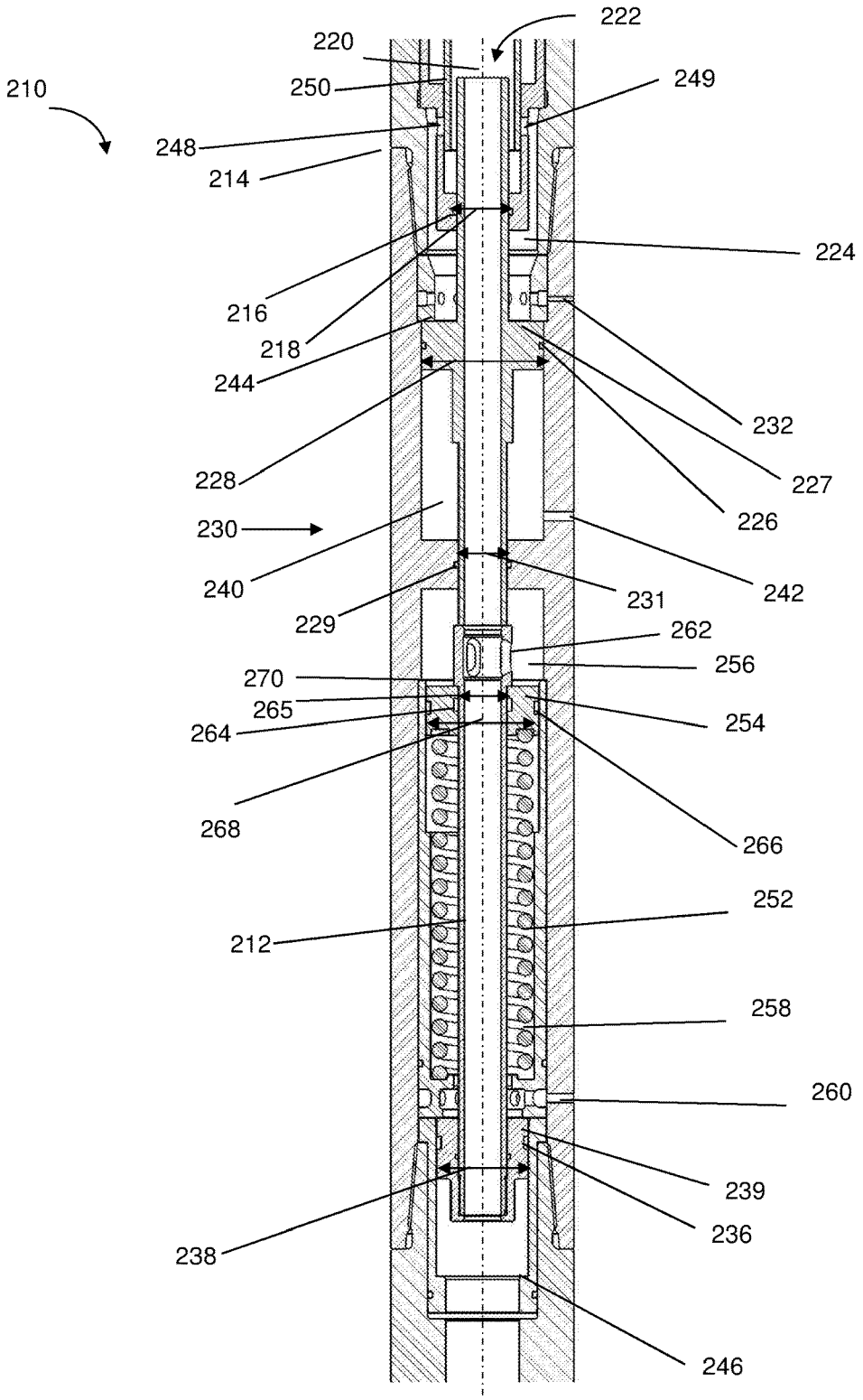
FIG. 1 is a schematic sectional view of an embodiment of a downhole tool according to the invention comprising an activation piston, a retraction piston and a conditional piston set in the inactive configuration and subject to a third pressure condition.

Reference is first made to FIGS. 1 to 5 of the drawings, which is a schematic sectional view of a downhole tool 210 according to the invention with an activation member 212 in an inactive configuration located in a tubular body 214, that forms part of a downhole string (partially shown). The tool comprises a first seal 216 that defines a first cross-sectional sealing area 218 of the activation piston member 212 perpendicular to a central longitudinal axis 220 of the tool 210. The tool 210 further comprises an internal throughbore 222 for communicating a fluid downhole. The first seal 216 separates a first chamber 224 from a fluid in the throughbore 222 in the first configuration shown in FIGS. 1, 2 and 3.

In the embodiment shown, the activation member 212 comprises an activation piston such as defined with a pistonhead 227, which is shown as a downforce piston. The tool 210 further comprises a second seal 226 that defines a second cross-sectional sealing area 228 of the activation member 212 perpendicular to the central longitudinal axis 220 of the tool 210. In the first configuration shown in FIGS. 1, 2 and 3, the activation member 212 is in an inactive position, which is an uphole position for the embodiment shown. In use, the tool 210 is used in a bore (not shown) with a fluid pressure in an annulus 230 external to the tool 210. The first chamber 224 is in fluid communication with the annulus 230 via a first external port 232.

Figure 2:
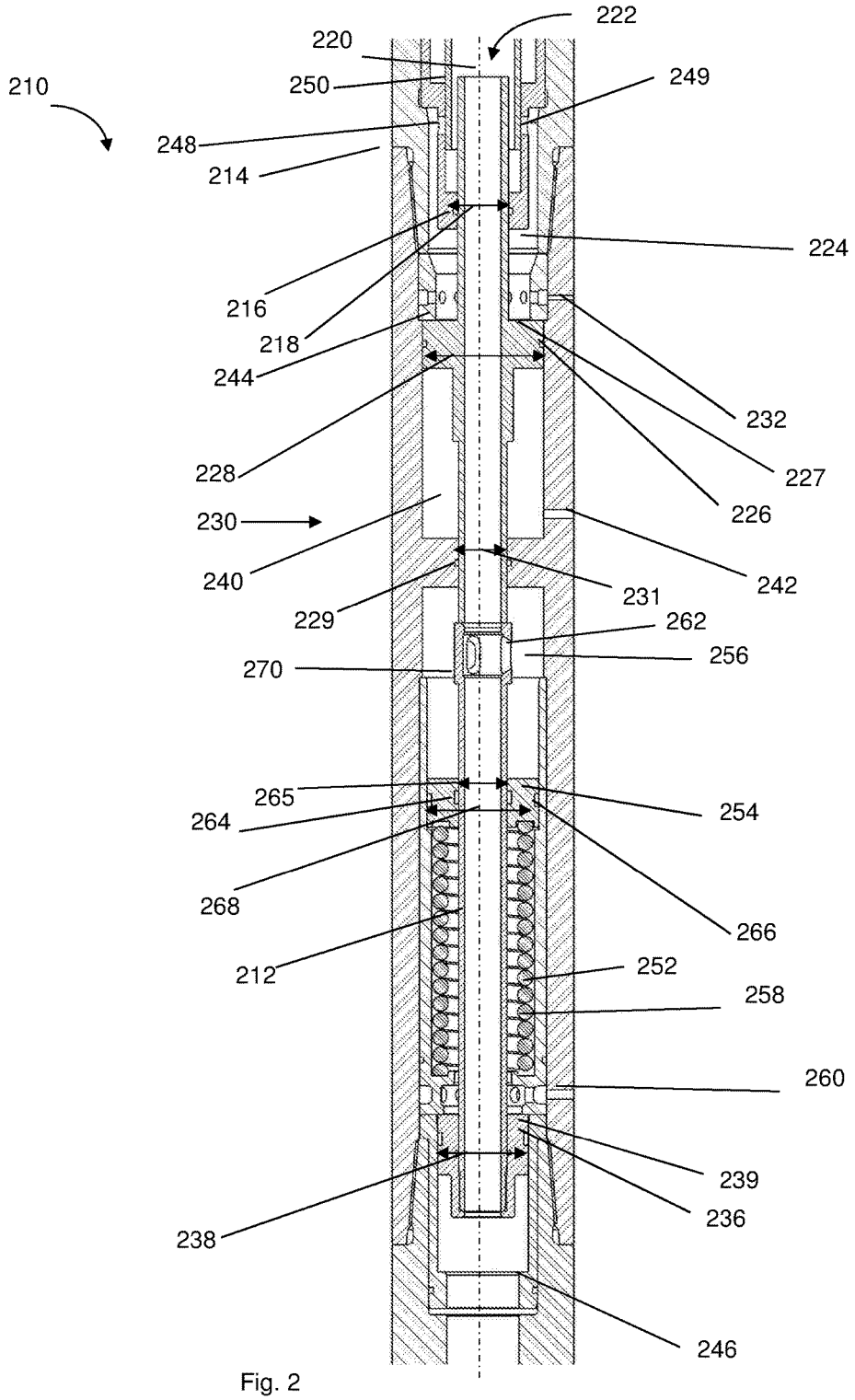
FIG. 2 is a schematic sectional view of the downhole tool of FIG. 1 with the tool set in the inactive configuration and subject to a first pressure condition.
Figure 3:
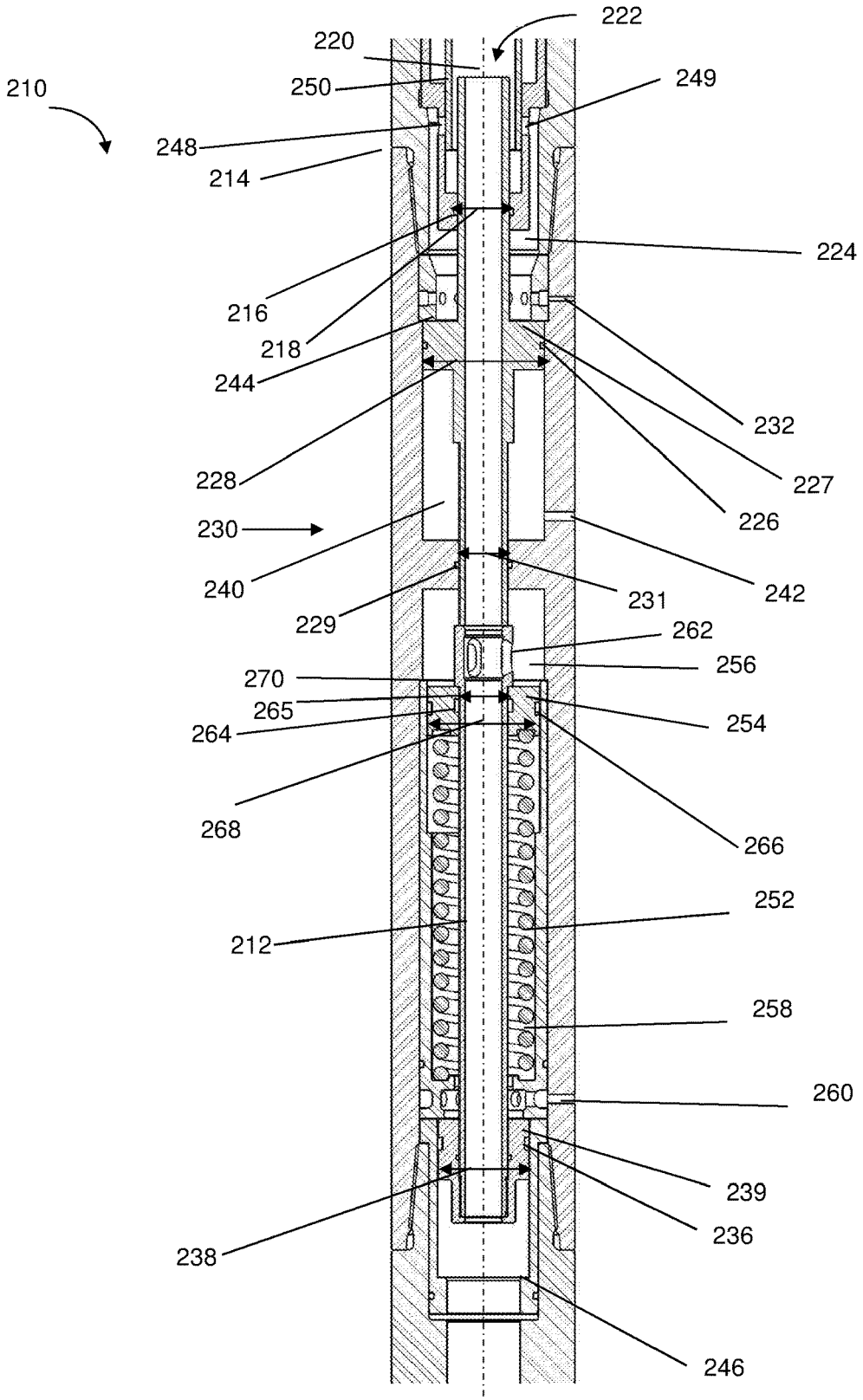
FIG. 3 is a schematic sectional view of the downhole tool of FIG. 1 with the tool set in the inactive configuration and subject to a second pressure condition.

Furthermore, the first chamber 224 is in fluid communication with the throughbore 222 via an inner annulus 234 defined adjacent a retractable sleeve 250. In the configuration of FIGS. 1, 2 and 3, the inner annulus 234 is a relatively small opening that inhibits the passage of fluid from the throughbore 222 into the first chamber 224 such that there is a substantial pressure difference between the throughbore 222 and the first chamber 224. The first external port 232 inhibits the passage of fluid less than the inner annulus 234 such that there is no substantial pressure difference between the first chamber 224 and the annulus 230. The first seal 216 can be considered to be an effective seal between the activation member 12 and the body 214 in the inactive configuration of FIGS. 1, 2 and 3. Fluid pressure in the first chamber 224 in the configuration of FIGS. 1, 2 and 3 is substantially the same as fluid pressure in the annulus 230. Accordingly, a downhole force caused by internal fluid pressure in the throughbore 222 acts on the first cross-sectional sealing area 218.

The tool 210 comprises a second piston in the form of a retraction piston 239. The retraction piston 239 is configured within the tool 210 to act in an opposing axial direction to the activation piston 227, which means acting uphole in the embodiment shown (up as viewed). The retraction piston 239 is used against the activation piston 227 to drive or bias the cutter blades (not shown) to the retracted position.

Figure 4:
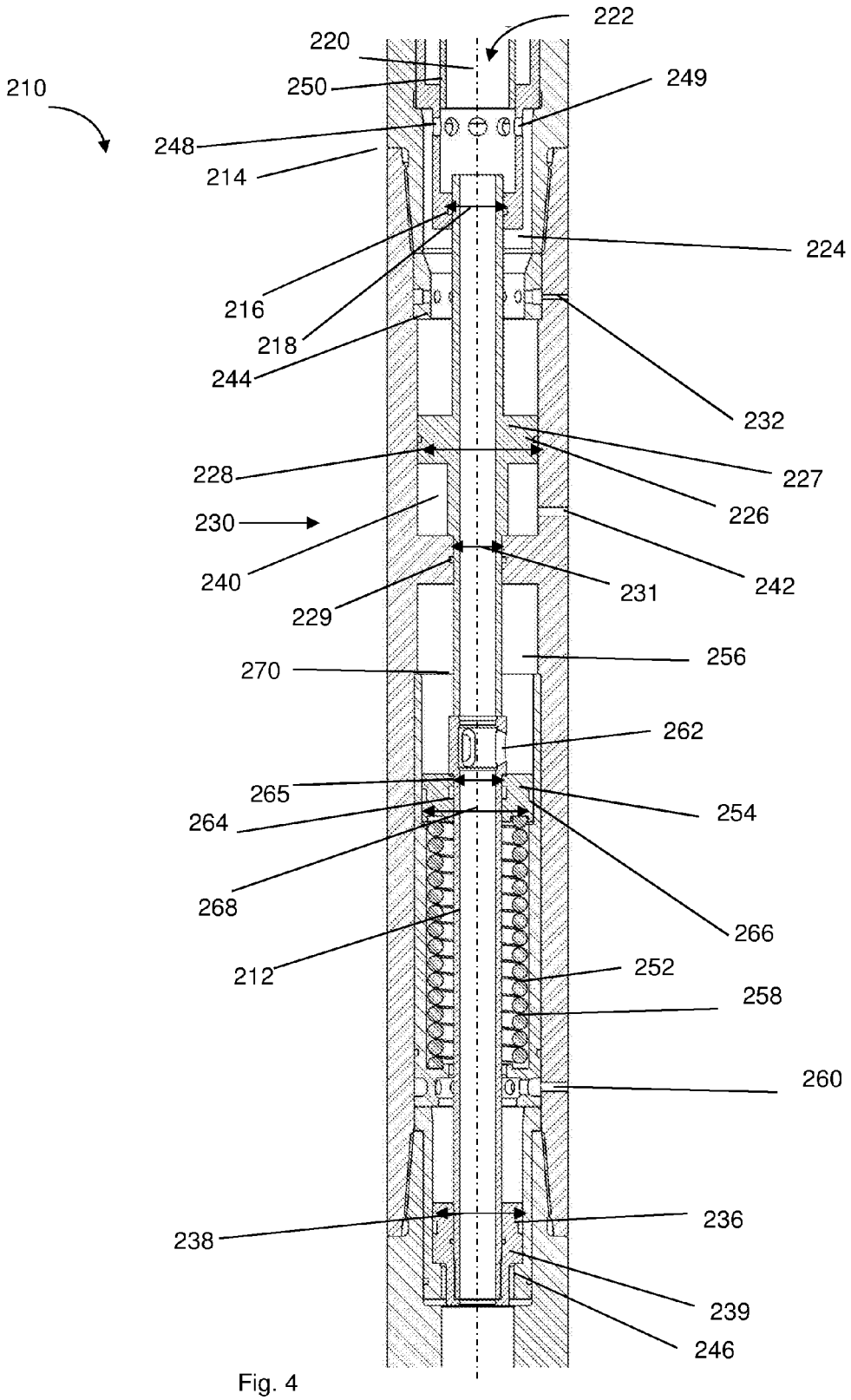
FIG. 4 is a schematic sectional view of the downhole tool of FIG. 1 with the tool set in the active configuration and subject to the first pressure condition.

The tool 210 comprises a third piston, which is a conditional or counter piston 254 in the embodiment shown. The conditional piston 254 is configured to act in the opposing direction to the retraction piston 239 at least when the tool is subject to the first pressure condition. The conditional piston 254 is configured to act in the same direction as the activation piston 239, at least when the tool 210 is subject to the first pressure condition and when the tool 210 is in the second configuration (FIG. 4).

The conditional piston 254 is configured to act in an opposite direction when the tool 210 is subject to the second pressure condition compared to when the tool 210 is subject to the first pressure condition. The conditional piston 254 changes direction when the pressure condition changes between the first and second pressure conditions. The tool comprises a third seal 229 defining a third sealing area 231 between the internal or tool bore (pressure) and the second fluid chamber 240. The first and third sealing areas 218, 231 each and in combination define a relatively small sealing area compared to the second sealing area 228. The first and third sealing areas 218, 231 define sealing areas that are substantially equal or of marginal difference.

The tool 10 further comprises a fourth seal 236 that defines a fourth cross-sectional sealing area 238 of the retraction piston 227 perpendicular to the central longitudinal axis 220 of the tool 210. In the embodiment shown in FIG. 1, the fourth seal 236 separates a second chamber 240 from a fluid in the throughbore 222. Accordingly, an uphole force caused by internal fluid pressure in the throughbore 222 acts on the third cross-sectional sealing area 238. The second chamber 240 is in fluid communication with the annulus 230 via a second chamber external port 242. Accordingly, fluid pressure in the second chamber 240 is substantially the same as fluid in the annulus 230. The second chamber 240 is separated from the first chamber 224 by the second seal 226. As the fluid pressure in the first and second chambers 224, 240 is substantially the same as fluid pressure in the annulus 230 in the configuration of FIGS. 1, 2 and 3, there is substantially no pressure differential across the second seal 226, between the first chamber 224 and the second chamber 240. Accordingly, there is no net hydraulic force at the second cross-sectional sealing area 228 in the configuration of FIGS. 1, 2 and 3. In the first pressure condition, fluid pressure in the throughbore 222 is greater than the fluid pressure in the annulus 230. Accordingly, as the fourth cross-sectional sealing area 238 is larger than the first cross-sectional sealing area 218; and substantially a same internal fluid pressure in the throughbore 222 and a same annular fluid pressure act on both the first and fourth cross-sectional sealing areas 218, 238 in the configuration of FIGS. 1, 2 and 3; there is a net hydraulic bias exerted on the activation member 212 in an uphole direction by the retraction piston 239 when the internal fluid pressure exceeds the annular fluid pressure (FIG. 2).

The tool 10 further comprises a proximal stop 244 to limit uphole movement of the activation member 212; and a distal stop 246 to limit downhole movement of the activation member 212. In use in the inactive configuration of FIG. 1, when toolbore pressure in the throughbore 222 is greater than fluid pressure in the annulus 230, such as typical during a drilling, reaming, cleaning or injection procedure, the net hydraulic bias of the activation member 212 in an uphole direction presses the activation member 212 against the proximal stop 244.

To transition the activation member 212 from the inactive configuration of FIG. 1 to an active configuration shown in FIG. 4, a first internal configurable port 248 is exposed to toolbore pressure in the throughbore 222 by a relative axial retraction of the sleeve 250. The first internal port 248 provides a larger fluid passageway than the inner annulus 234. Further internal ports 249 are arranged around the longitudinal axis 220, such that a cross-sectional flow area defined by the first and further internal ports 248, 249 is substantially larger than the cross-sectional flow area defined by the inner annulus 234. The first and further internal ports 248, 249 allow fluid to enter the first fluid chamber 224 such that there is no substantial pressure difference between the throughbore 222 and the first chamber 224. The first external port 232 then acts as a flow restriction whereby a substantial pressure differential is created across the first external port 232. The first external port 232 inhibits the passage of fluid more than the first and further internal ports 248, 249, such that there is a substantial pressure difference between the first chamber 224 and the annulus 230. The first seal 216 can be considered to be an ineffective or redundant seal between the activation member 212 and the body 214 when transitioning from the inactive configuration of FIG. 1 to the active configuration of FIG. 4. Accordingly pressure in the first chamber 224 becomes substantially the same as the toolbore pressure in the throughbore 222. The pressure difference across the first seal 216 becomes negligible when the first chamber 224 is fully exposed to the toolbore pressure, such as in FIG. 4. Accordingly, no substantial net force caused by internal fluid pressure in the throughbore 222 acts on the first cross-sectional sealing area 218 when the first and further internal ports 248, 249 are fully exposed to toolbore pressure, such as in the configuration of FIG. 4. Accordingly, the second seal 226 can be considered to be the effective seal between the activation member 212 and the body 214 in the active configuration of FIG. 4; and when transitioning from the inactive configuration of FIGS. 1, 2 and 3 to the configuration of FIG. 4 by exposing the first and further internal ports 248, 249.

When transitioning from the inactive configurations of FIG. 1, 2 or 3 to the active configuration of FIG. 4, as the fluid pressure in the first chamber 224 becomes substantially the same as the toolbore pressure, and the fluid pressure in the second chamber 240 remains substantially the same as fluid pressure in the annulus 230 in the configuration of FIG. 4, a substantial pressure differential across the second seal 226 is created. Accordingly, there is a net hydraulic force at the second cross-sectional sealing area 228 in the configuration of FIG. 4. When the toolbore pressure is greater than the annular fluid pressure, net hydraulic force at the second cross-sectional sealing area 228 acts downhole. Since the fourth cross-sectional sealing area 238 is smaller than the second cross-sectional sealing area 228; and substantially the same internal fluid pressure in the throughbore 222 and the same annular fluid pressure act on both the second and fourth cross-sectional sealing areas 228, 239 in the configuration of FIG. 4; there is a net hydraulic bias exerted on the activation member 212 in a downhole direction, moving the activation member against the retraction piston 239 from the inactive position of FIG. 1, 2 or 3 to the active position of FIG. 4, when the internal pressure sufficiently exceeds the external pressure to overcome a mechanical bias of a spring 252. Accordingly, when the first and further internal ports 248, 249 are fully exposed to toolbore pressure, and the toolbore pressure is sufficiently greater than the annular fluid pressure, the net hydraulic bias of the activation member 212 in a downhole direction moves the activation member 212 to the active position of FIG. 4 and presses the activation member 212 against the distal stop 246.

The tool 210 can be reconfigured to return the activation member 212 from the active position of FIG. 4 to the inactive position of FIG. 1, 2 or 3 by a relative axial extension of the sleeve 250 to the position of FIG. 1, 2 or 3. Accordingly, the first and further internal ports 248, 249 are not fully exposed to toolbore pressure and a pressure differential across the inner annulus 234 is generated. Pressure in the first chamber 224 drops below that of the toolbore pressure in the throughbore 222, reducing the pressure differential between the first chamber 224 and the second chamber 240. Accordingly, the net force acting on the second cross-sectional sealing area 228 reduces, such that the uphole force acting on the fourth cross-sectional sealing area 238 exceeds the downhole forces acting on the first and second cross-sectional sealing areas 218, 228; and the activation member 212 is moved upwards towards the position of FIG. 1, 2 or 3 by the retraction piston 239. Pressure in the first chamber 224 returns to that of the annulus 230, and of the second chamber 240, such that pressure across the second seal 226 becomes balanced. As the fourth cross-sectional sealing area 238 is greater than the first cross-sectional sealing area 218, toolbore pressure generates a net uphole force on the activation member 212 via the retraction piston 239, urging the activation member 212 against the proximal stop 244. The activation member 212 can be selectively cycled between the inactive configuration of FIG. 1, 2 or 3 and the active configuration of FIG. 4 by controlling the sleeve 250. When in the active configuration of FIG. 4, the blades (not shown) can be selectively extended by controlling the internal pressure relative to the external pressure.

The spring 252 is configured to mechanically bias the activation member 212 uphole. Accordingly, the net hydraulic bias of the activation member 212 must overcome the mechanical bias of the spring 252 to move the activation member 212 from the inactive position of FIG. 1, 2, 3 or 5 to the active configuration of FIG. 4. The mechanical bias of the spring 252 assists in returning the activation member 212 to the inactive position of FIG. 1, 2, 3 or 5; and in urging the activation member against a proximal stop 244.

Figure 5:
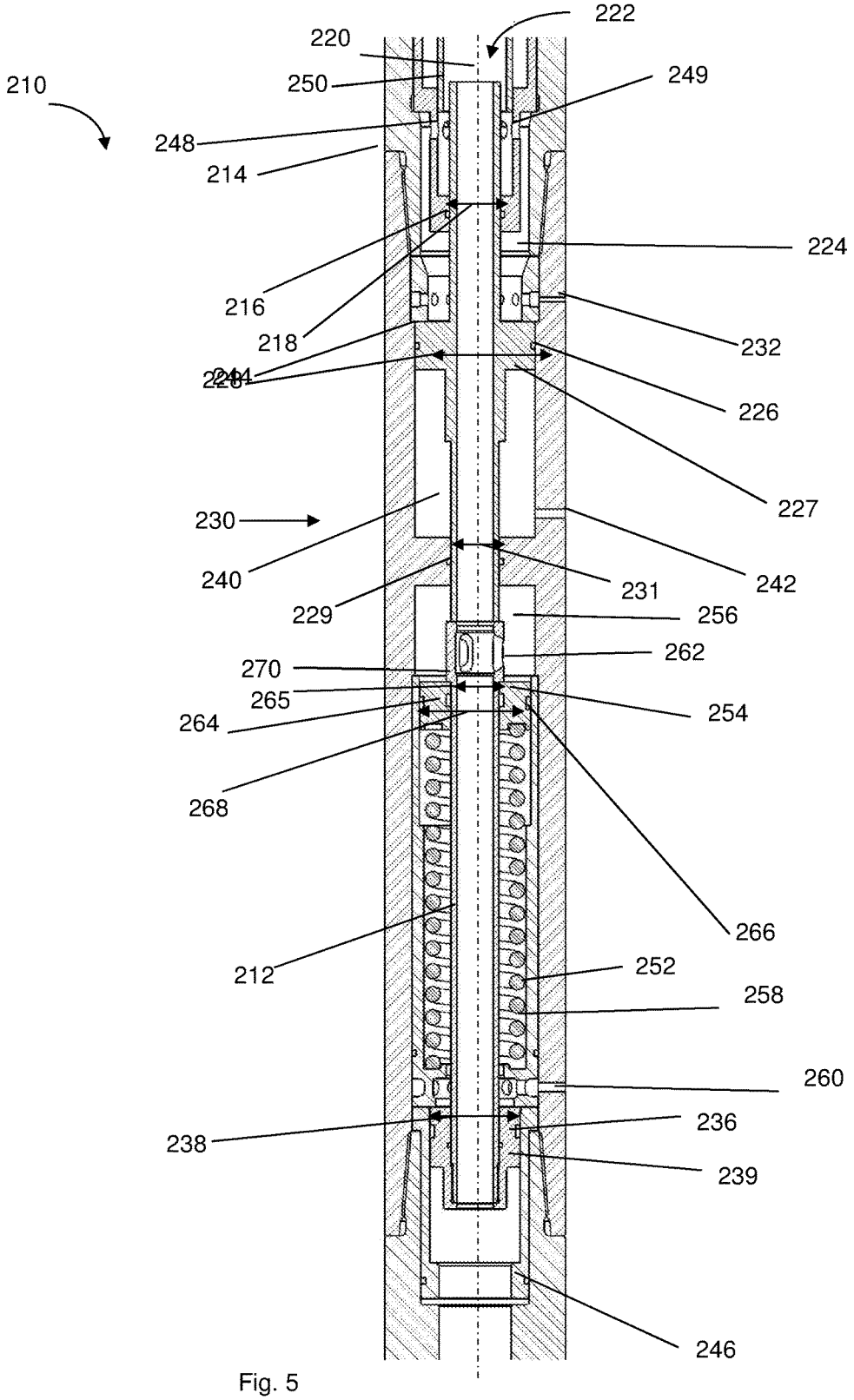
FIG. 5 is a schematic sectional view of the downhole tool of FIG. 1 with the tool set in the active configuration and subject to the second pressure condition.

A further inactive position of the tool 210 is shown in FIG. 5. Rather than a toolbore pressure in a throughbore 222 being greater than a fluid pressure in an annulus 230, the toolbore pressure in FIG. 5 is substantially equal to (or less than) the annular pressure. Accordingly, any net hydraulic bias of the activation member 212 may be negligible (or may be uphole). However, in any case, the mechanical bias of the spring 252 urges the activation member 212 uphole, against the proximal stop 244. The active configuration of FIG. 5 may be useful when returning the activation member from the extended position of the active configuration of FIG. 4 to an inactive position and optionally to one of the inactive configurations (of FIGS. 1 to 3). For example, when in the active configuration and active position of FIG. 4 with a toolbore pressure greater than the annular pressure, the toolbore pressure can be reduced relative to the annular pressure, such as by turning off a pump (not shown). Accordingly, the activation member 212 is returned to an inactive position shown in FIG. 5. Subsequently, the activation member 212 can be returned to the active position of FIG. 4 by increasing the toolbore pressure relative to the annular pressure, such as by turning the pump on. The sleeve 250 can be extended as required such that the first and further internal ports 248, 249 are not fully exposed to toolbore pressure to move or maintain the activation member 212 uphole against the proximal stop 244 with a hydraulic bias. The spring 252 can have a stiffness sufficient to maintain the activation member 212 against the proximal stop 244 when the toolbore pressure is less than the annular pressure, such as when a hydrostatic pressure in the annulus 230 is increased (e.g. during running-in).

Figure 6:
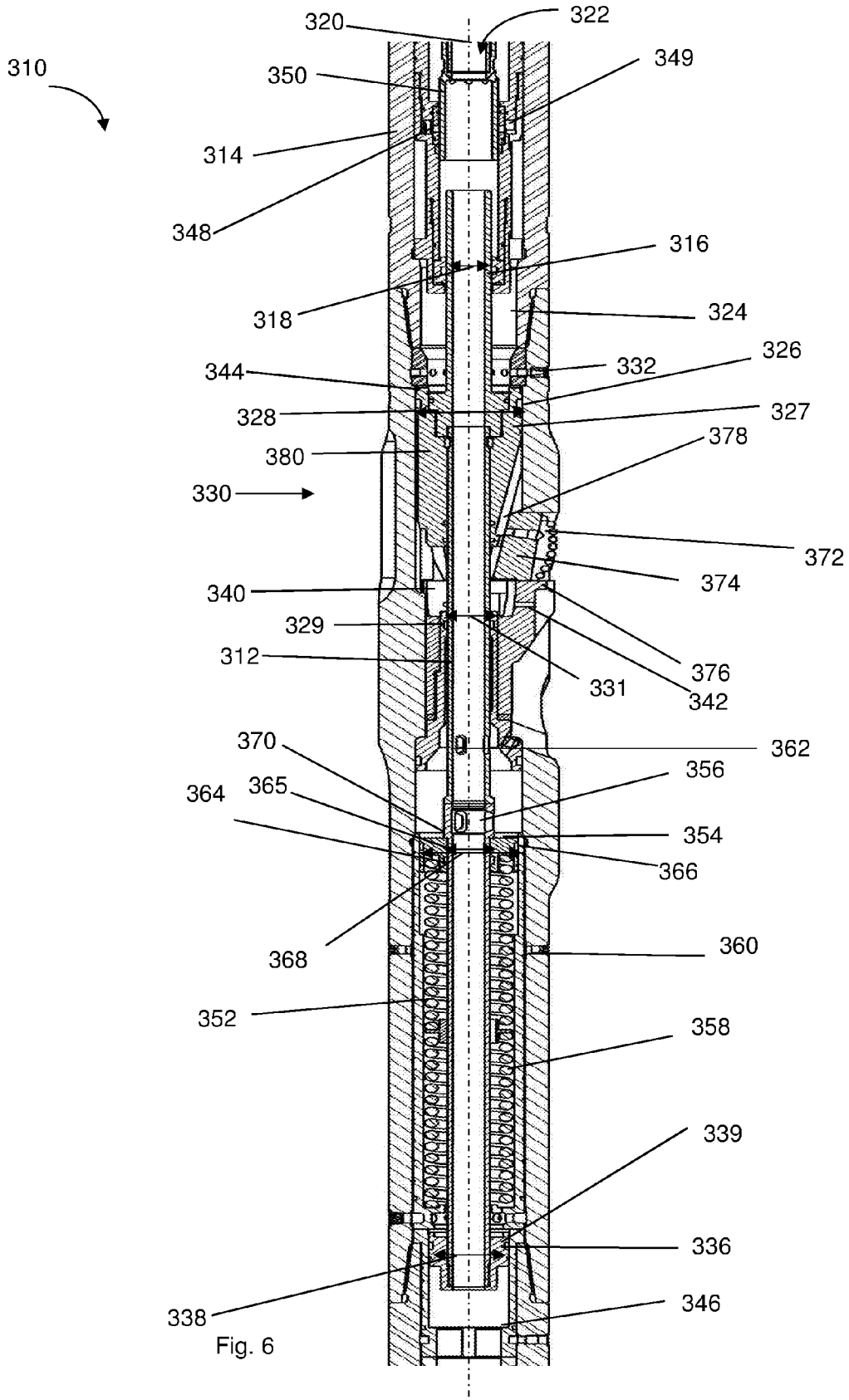
FIG. 6 is a schematic sectional view of an underreaming tool according to the invention with the tool set in an inactive configuration and subject to the third pressure condition.

The spring 252 acts on the conditional conditional piston 254 that helps define a third and a fourth chamber 258, 256 on respective sides of the conditional piston conditional piston 254. Accordingly, a fourth seal 236 of the embodiment of FIG. 6 is located between an interior of a body 214 and the third chamber 258.

The third chamber 258 comprises a third chamber external port 260 such that the third chamber 258 is in fluid communication with the annulus 230; and fluid pressure in the third chamber 258 is substantially the same as an annular fluid pressure. Accordingly, a pressure difference across the fourth seal 236 is created by a pressure differential between a toolbore pressure and the annular pressure, generating a hydraulic counterbias acting on a fourth cross-sectional sealing area 238 of the fourth seal 236.

The fourth chamber 256 comprises a fourth chamber internal port 262 such that the fourth chamber 256 is in fluid communication with a throughbore 222; and fluid pressure in the fourth chamber 256 is substantially the same as the toolbore pressure. The conditional piston conditional piston 254 comprises an inner seal 264 (fifth seal) and an outer seal 266 (sixth seal) such that the conditional piston conditional piston 254 is axially moveable with respect to the activation member 212 and the body 214 respectively; whilst fluidly separating the third and fourth chambers 258, 256. Accordingly, the inner seal 264 defines a fifth cross-sectional sealing area 265 and the outer seal 266 defines a sixth cross-sectional sealing area 268 between the third and fourth chambers 258, 256. A pressure differential between the toolbore pressure and the annular pressure results in a hydraulic force acting on the sixth cross-sectional sealing area 268, hydraulically urging the conditional piston 254 uphole or downhole accordingly. In the inactive configuration shown in FIG. 1, the toolbore pressure and the annular pressure are substantially equal, such that substantially no pressure differentials act across any of the first, second, third, fourth, inner or outer seals 216, 226, 236, 264 or 266. Accordingly substantially no hydraulic bias acts on either the conditional piston 254 or the activation member 212 in the configuration of FIG. 1. The conditional piston 254 engages a collar 270 of the activation member 212 urging the activation member 212 uphole as a result of a mechanical bias of the spring 252. Accordingly, the activation member 212 abuts a proximal stop 244 in the inactive configuration of FIG. 1.

In FIG. 1, hydrostatic pressure in the annulus 230 may create higher pressures in the first, second and third chambers 224, 240 and 258 than in the throughbore 222 and the fourth chamber 240. Accordingly, a greater downhole hydraulic force may act on the fourth cross-sectional sealing area 238 than an uphole hydraulic force acting on the first cross-sectional sealing area 218. As there is substantially no pressure differential across the second seal 226, a net downhole force may otherwise move the activation member 212 downhole to an active position, were the net force on the first, second and fourth seals 216, 226, 236 greater than an uphole mechanical force of the spring 252 acting on the collar 270 of the activation member 212. However, a pressure differential across the conditional piston 254 generates an uphole hydraulic force acting on the sixth cross-sectional sealing area 268, which is greater than the net force on the first, second and fourth seals 216, 226, 236; due to the sixth cross-sectional area 268 being larger than the difference between the first and fourth cross-sectional sealing areas 218, 238. Accordingly, a net hydraulic force acts uphole on the activation member 212, via the conditional piston 254 and the collar 270.

In the inactive configuration shown in FIG. 2, the toolbore pressure is increased relative to the annular pressure, when compared to FIG. 1. Pressure in the first, second and third chambers 224, 240 and 258 is substantially annular pressure, whilst pressure in the fourth chamber 256 is substantially toolbore pressure due to a fluid communication between the throughbore 222 and the fourth chamber 256 via the fourth chamber internal port 262. Accordingly an uphole force acts on the fourth cross-sectional sealing area 238 and a downhole force on the first cross-sectional sealing area 218. Pressure is balanced across the second seal 226 such that no net hydraulic force acts on the second cross-sectional sealing area 228. Pressure in the fourth chamber 256 exceeds pressure in the third chamber 258 such that a pressure differential is generated across the conditional piston 254 and a downhole force acts on the sixth cross-sectional sealing area 268. Accordingly, as the conditional piston 254 is movable relative to the activation member 212, the conditional piston 254 separates from the collar 270, moving downhole to the position shown in FIG. 2. Thereby the spring 252 is disconnected from the activation member 212, such that the resultant net force acting on the activation member 212 is a net hydraulic bias urging the activation member 212 against the proximal stop 244.

The inactive configuration of FIG. 3 is similar to that of FIG. 1. In the configuration shown in FIG. 3, the annular pressure is the same as the toolbore pressure, such as may be encountered when the tool 210 is run into a wellbore without a pump supplying a toolbore pressure. Accordingly, there are no pressure differentials, and the activation member 212 is urged uphole against the proximal stop 244 by the mechanical bias of the spring 252.

FIG. 4 shows the tool 210 in an active configuration with the activation member 212 transitioned from the inactive position of FIG. 2 to an activated position in FIG. 4. The toolbore pressure exceeds the annular pressure such that the conditional piston 254 does not exert an uphole force as a result of a pressure differential across the piston 254. The uphole force acting on the fourth cross-sectional area 238 generated by the pressure difference between the third chamber 258 and the toolbore pressure is overcome in the configuration of FIG. 4. The uphole force on the fourth cross-sectional area 238 and the uphole force of the spring 252 are overcome as the sleeve 250 is retracted, thus fully exposing the first and further internal ports 248, 249 to toolbore pressure, for fluid flow into the first chamber 224. Fluid pressure in the first chamber 224 is toolbore pressure such that no net axial hydraulic force acts on the first cross-sectional sealing area 218. Accordingly, as fluid pressure in the second chamber 240 is annular fluid pressure, a fluid pressure differential across the second seal 226 generates a net downhole hydraulic force acting on the second cross-sectional sealing area 228. The net downhole force acting on the second cross-sectional sealing area 228 is greater that the combination of the uphole force on the fourth cross-sectional sealing area 238 and the uphole force of the spring 252. The uphole force on the spring is at least partially overcome by the pressure differential across the conditional piston 254. Accordingly, the activation member 212 is propelled downhole against a distal stop 246 as shown in FIG. 4.

FIG. 5 shows the tool 210 in an active configuration with the activation member 212 returned to an inactive position similar to that of FIG. 1. In the configuration of FIG. 5, the tool bore pressure has been relatively reduced compared to FIG. 4, such as by turning off the pump. Accordingly, fluid pressure in the throughbore 222 and the first, second, third and fourth chambers 224, 240, 258, 256 is substantially annular fluid pressure and there are no pressure differentials acting across the first, second, third or fourth or inner or outer seals 216, 226, 236, 264, 266. Thus, there is no net hydraulic force acting on the activation member 212. Accordingly, the activation member 212 is urged uphole by the spring 252 exerting an uphole mechanical force via the conditional piston 254. The activation member 212 is moved uphole to the position of FIG. 5, where it is urged against the proximal stop 244. In the configuration shown in FIG. 5, the second and further internal ports 248, 249 are fully exposed to toolbore pressure as the sleeve 250 is in a retracted position. Subsequently, the activation member 212 may be selectively moved between the configurations of FIGS. 1 to 5 by controlling the position of the sleeve 250 and the toolbore pressure (via the pump).

One of several methods of controlling the position of the sleeve 250 may be used. For example, the position of the sleeve 250 may be controlled using an indexer (not shown), such as actuated by flow rate cycles through the tool 210 or a drop-ball/s. The position of the sleeve 250 may alternatively by controlled using an electric motor (not shown) triggered by a signal. The signal may be sent to the tool 210 via any telemetry method, including the telemetry method based on detection of drill string rotation disclosed in U.S. Patent Application Ser. No. 61/803,696 assigned to the assignee of the present invention, the disclosure of which is incorporated herein by reference.

Reference is now made to FIGS. 6 to 10 of the drawings, showing another embodiment of a downhole tool 310 according to the invention, with each of FIGS. 6 to 10 respectively showing a configuration and position generally similar to that of the respective positions and configurations of FIGS. 1 to 5. The tool 310 is generally similar to the tool 210 shown in FIG. 1, and as such like components share like reference numerals, incremented by 100. The tool 310 is an under-reaming tool intended for location in a drill string or bottom hole assembly (BHA) with a drill bit (not shown) being provided on the distal end of the string below the under-reaming tool. Accordingly, the tool 310 comprises a tubular body 314 defining a through bore 322 so that fluid may be pumped from surface, through the string incorporating the tool 310, to the drill bit, the fluid then passing back to surface through the annulus 330 between the drill string and the surrounding bore wall.

The body 314 comprises a number of body sections which are coupled to one another using conventional threaded couplings. The tool 310 features three extendable cutters 372 (only one shown in the drawings). As will be described, when the tool 310 is in an inactive configuration, the cutters 372 are in a first, retracted position, as illustrated in FIG. 61.

The tool 310 is configured to be cycled between a first configuration in which the cutters 372 are retracted and a second configuration in which the cutters 372 are movable between retracted and extended positions. The tool 310 is configured to prevent extension of the cutters 372 by an external fluid or external fluid pressure in the first and/or second configuration/s, such as by external fluid entering the tool.

The cutters 372 are formed on cutter blocks 374 located in windows 376 of corresponding shape in the wall of the body 314. Each cutter block 374 features an inclined cam face which co-operates with a surface 378 of a cam member 380 associated with an activation member 312. The cam member 380 is operatively associated with the activation member 312. In the embodiment shown, the activation member 312 comprises multiple generally tubular elements.

In operation, the tool 310 is set up as shown in FIG. 6 for tripping in hole. As described above, the tool 310 will be incorporated in a BHA above the drill bit. As the drill string is made up above the tool 310, and the string is tripped into the hole, the tool is maintained with the cutters 372 retracted, as shown in FIG. 6.

Figure 7:
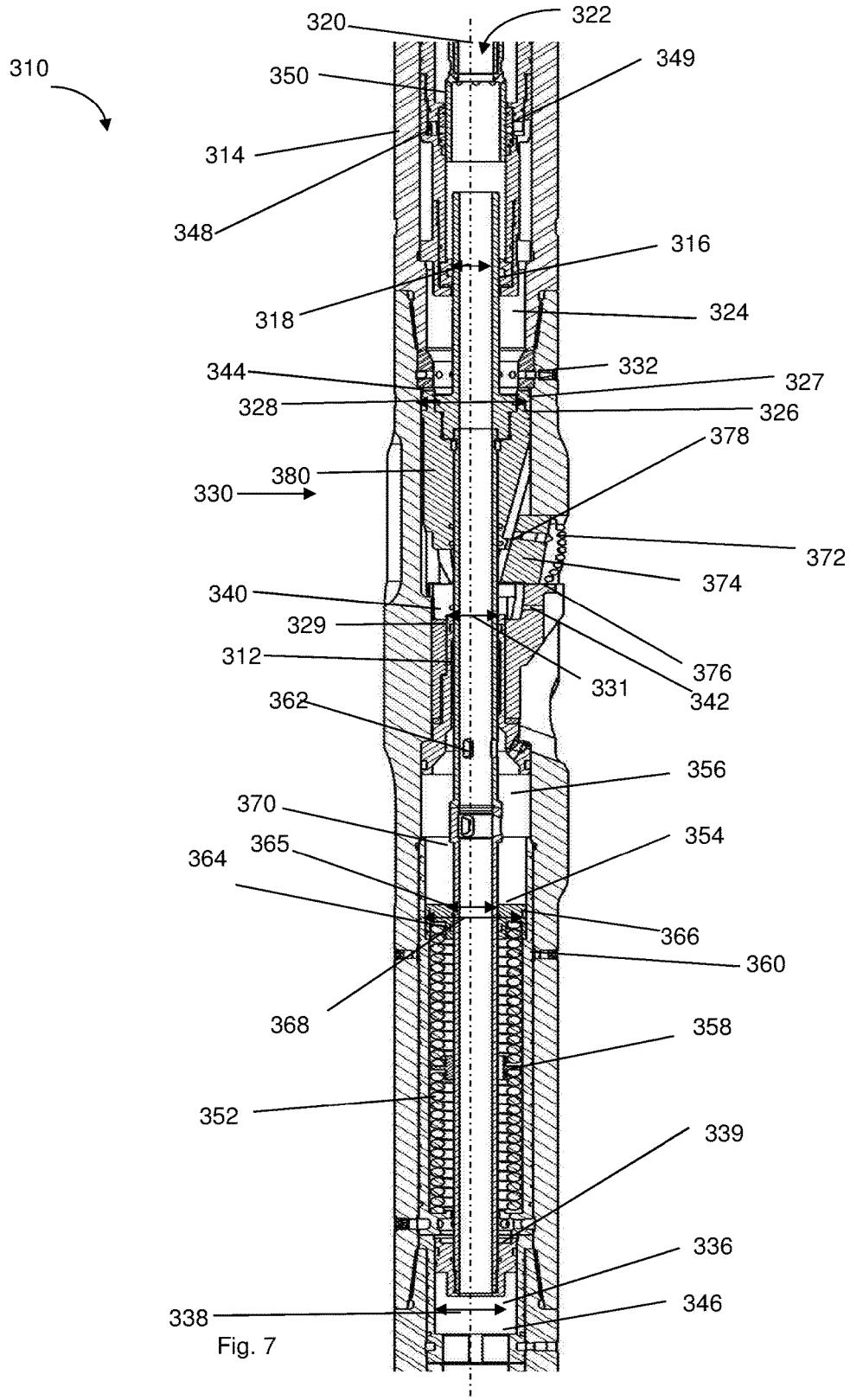
FIG. 7 is a schematic sectional view of the underreaming tool of FIG. 6 with the tool set in the inactive configuration and subject to the first pressure condition.
Figure 8:
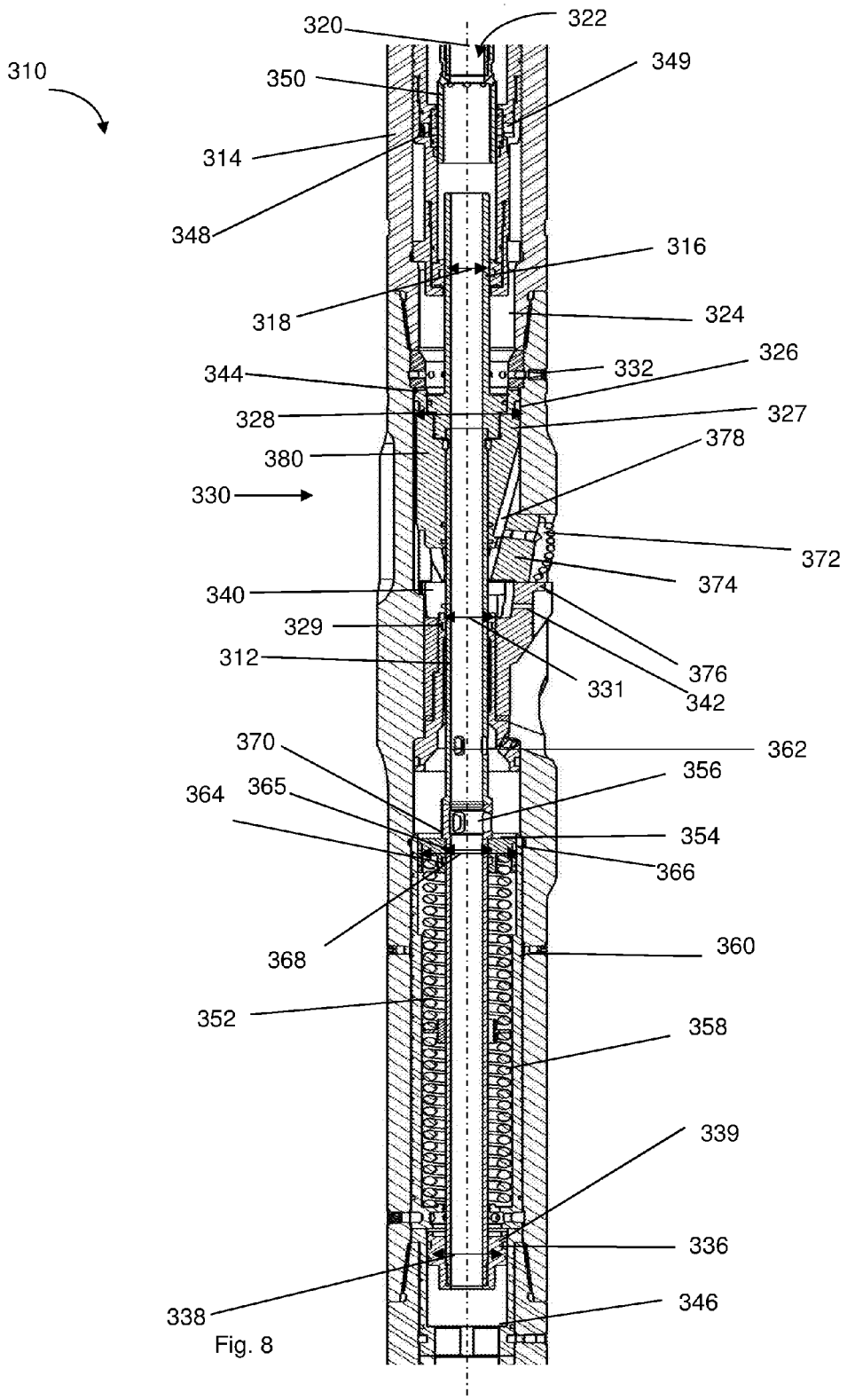
FIG. 8 is a schematic sectional view of the underreaming tool of FIG. 6 with the tool set in the inactive configuration and subject to the second pressure condition.

Once the drill string has been made up to the appropriate depth drilling fluid will be circulated through the drill string. This results in the internal pressure rising. In FIGS. 6, 7 and 8, a flow into a first chamber 324 is prevented. In other embodiments, a first internal port has is set with a tight Total Flow Area (TFA) in the first configuration (e.g. compared to a higher TFA out of the first chamber via a first external port 232). The TFA of the first external port 232 is 0.50 $cm^2$. Accordingly, in the first configuration of FIGS. 6, 7 and 8 the pressure in the first chamber 224 approximates pressure external to the tool 310, in the annulus 330.

In FIGS. 6, 7 and 8, the activation member 312 is in an inactive position, such that the cutters 372 are retracted and do not protrude beyond the external diameter of the body 314. Fluid can pass through tool 310, for example to the drill bit below the tool 310. The configurations of FIGS. 6 and 8 are similar to that of FIGS. 1 and 3, with a pump switched off such that toolbore pressure is equal to or lower than an annular pressure.

The configuration of FIG. 7 is similar to that of FIG. 2, whereby the activation member 312 is maintained in an inactive configuration, urged against a proximal stop 344, by the mechanical bias of the spring 352 and a net hydraulic force acting on a first, second and fourth cross-sectional sealing area 318, 328, 338 uphole. The toolbore pressure exceeding the annular pressure maintains the activation member 312 in an inactive configuration, with the cutters 372 retracted.

Figure 9:
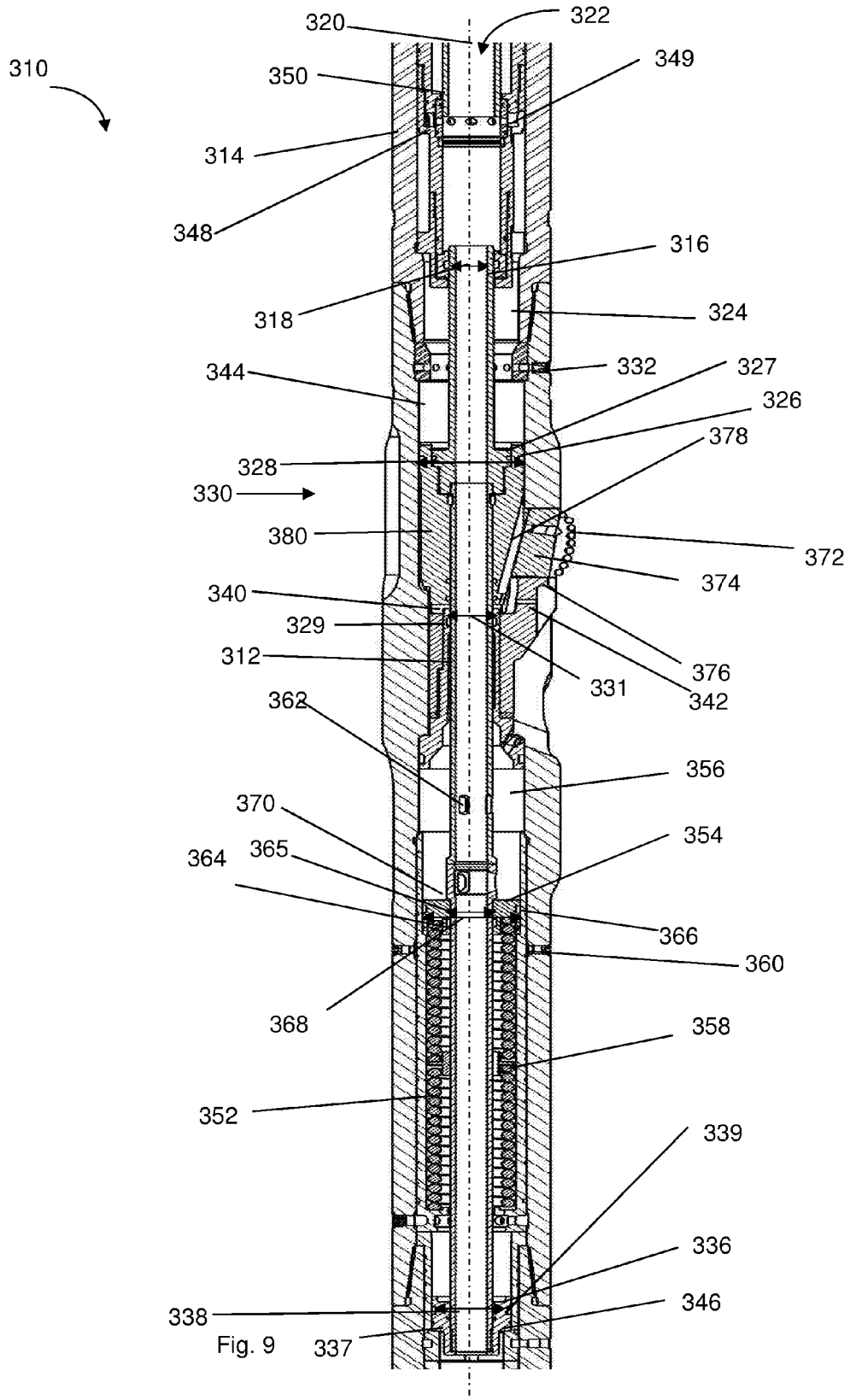
FIG. 9 is a schematic sectional view of the underreaming tool of FIG. 6 with the tool set in the active configuration and subject to the first pressure condition.
Figure 10:
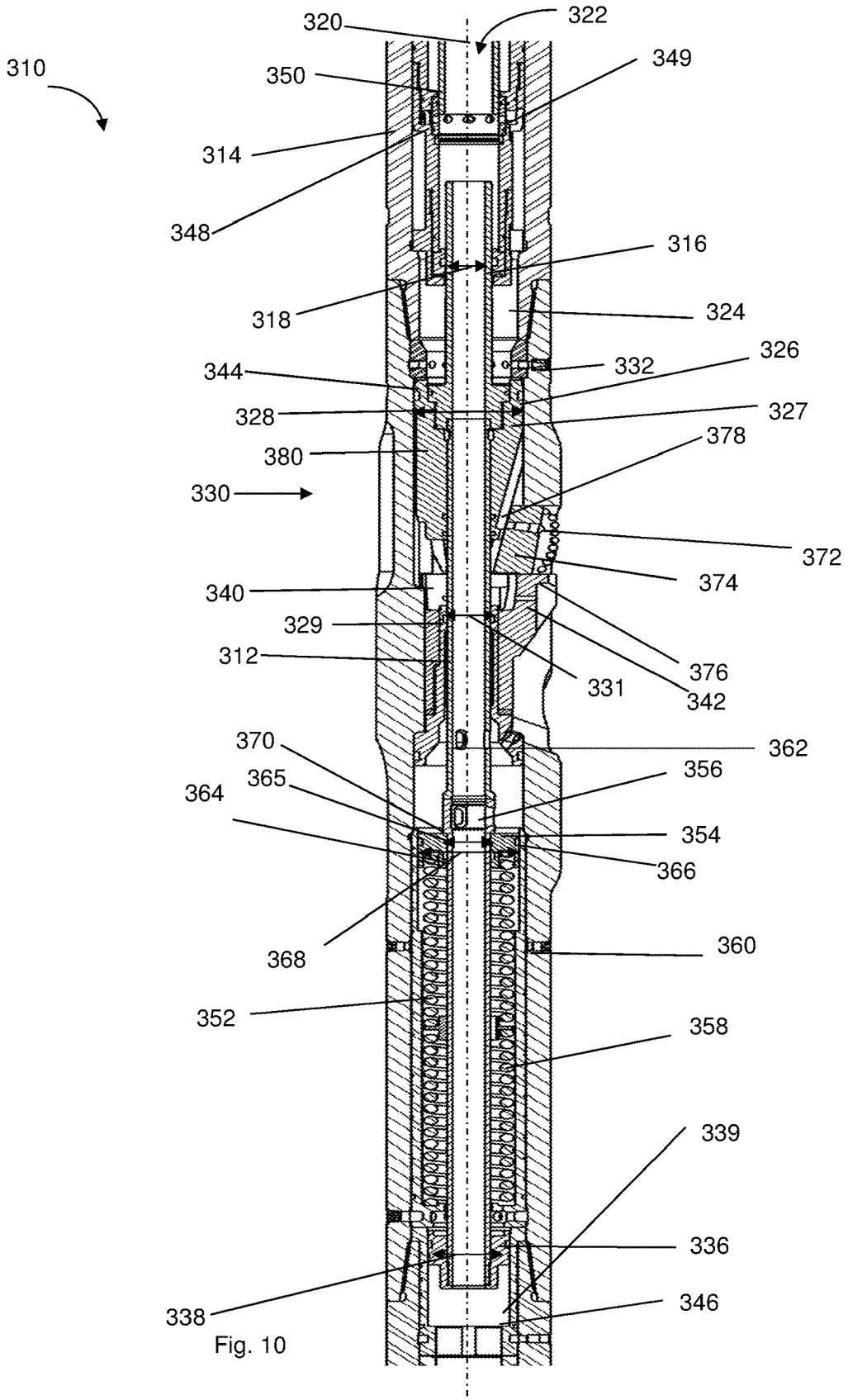
FIG. 10 is a schematic sectional view of the underreaming tool of FIG. 6 with the tool set in the active configuration and subject to the second pressure condition.

When the cutters 372 are required to be extended, such as for a reaming operation, a signal is sent to switch the TFA. To extend the cutters 372 and maintain the cutters 372 in the extended configuration, the TFA into first chamber 324 is set to an open TFA; that is a TFA greater than the first external port 332 TFA. In the embodiment shown, the TFA is set to 1.0 $cm^2$ in FIG. 9, such that the pressure in the first chamber 324 approximates the toolbore pressure. In the embodiment shown, the TFA into the first chamber 324 is increased by retracting a sleeve 350, reconfiguring the tool to the active configuration of FIG. 4, thus exposing a first and further internal ports 348, 349 fully to the toolbore pressure, as shown in FIG. 9. When toolbore pressure exceeds annular pressure, the activation member 312 moves to the active position of FIG. 9, similar to that of FIG. 4. The downhole axial movement of the activation member 312 with its associated cam member 380 causes the cutter block 374 to be forced radially outwards through contact with the cam surface 378. The net downhole hydraulic bias of the activation member 312 due to the toolbore pressure maintains the cutters 372 in the extended position of FIG. 9 during operation.

Upon completion of a reaming operation, or a section of a reaming operation, a further signal can be sent to switch the TFA from the open to the closed TFA. Accordingly, the TFA into the first chamber 324 will become less than the TFA of the first external port 332; and the pressure in the first chamber 324 will reduce to be substantially the same as the annular fluid pressure. Accordingly, the net hydraulic force will be zero as in FIG. 6. Similarly, the pump may be switched off, eliminating any net hydraulic force acting on the activation member 312 such that the spring 312 forces the activation member uphole against the proximal stop 344, as in the configuration of FIG. 10, similar to that of the tool 210 in FIG. 5. As the cutter block 374 is slidably connected to the cam surface 378 associated with the activation member via a dovetail interface, the cutter block 374 and cutters 372 are radially retracted as the activation member 312 moves uphole. As with the previous embodiment, the tool 310 can be selectively varied between the active and inactive configurations of FIGS. 6 to 10 by controlling the sleeve 350. The cutters 372 can be selectively extended or retracted in the second configuration by controlling the toolbore pressure relative to the annular pressure, such as by cycling the pump on and off.

It will be apparent to those of skill in the art that the above described embodiments are merely exemplary of the present invention, and that various modifications and improvements may be made thereto, without departing from the scope of the invention. For example, where a first seal has been included between a first chamber and an internal body fluid of a tool, and an internal port between the first chamber and the internal body fluid provides a flow restriction, the skilled person will appreciate that in an alternative embodiment of a tool the first seal and the first flow restriction may be combined, such that the tool does not comprise a first seal as such.

It will be appreciated that any of the aforementioned tools 210, 310 may have other functions in addition to the mentioned functions, and that these functions may be performed by the same tool 210, 310.

Where some of the above apparatus and methods have been described in relation to an underreaming tool 310; it will readily be appreciated that a similar activation member 312 may be for use with other downhole tools, such as drilling, cleaning, and/or injection tools, or the like.

Where features have been described as downhole or uphole; or proximal or distal with respect to each other, the skilled person will appreciate that such expressions may be interchanged where appropriate. For example, the skilled person will appreciate that where the first chamber is located uphole of the second chamber in the embodiments shown; in an alternative embodiment, the first chamber may be located downhole of the second chamber. Accordingly, the activation member may move uphole when activated.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. An under-reaming tool comprising:

a body;

a plurality of extendable cutters coupled to the body, wherein the cutters have an extended position extending from the body and a retracted position retracted into the body, the under-reaming tool configured to be cycled between a first configuration in which the cutters are in the retracted position and a second configuration in which the cutters are movable between the retracted position and the extended position; and an activation member configured to move the cutters between the retracted position and the extended position, the activation member comprising an effective sealing area;

wherein the under-reaming tool is configured to selectively vary the effective sealing area to selectively vary a hydraulic bias of the activation member; and wherein the under-reaming tool is configured to prevent the transition of the cutters to the extended position in response to an external fluid pressure outside the body in the first configuration, in the second configuration, or in both the first configuration and the second configuration.

2. The under-reaming tool of claim 1 further comprising a counterpiston disposed in the body, wherein the counterpiston is configured to transition the cutters to the retracted position or prevent transition of the cutters to the extended position when the external fluid pressure is greater than an internal fluid pressure inside the body.

3. The under-reaming tool of claim 2, wherein the counterpiston is configured to transition the cutters to the retracted position or prevent transition of the cutters to the extended position when the under-reaming tool is in the first configuration or the second configuration.

4. The under-reaming tool of claim 1 wherein the under-reaming tool is configured to expose at least a portion of the activation member to a fluid pressure differential only in the second configuration; and wherein the under-reaming tool is configured to at least limit exposure of the activation member to a pressure differential in the first configuration.

5. The tool according to claim 1 further comprising:

a first seal defining a first cross-sectional sealing area oriented perpendicular to a longitudinal axis of the activation member; and a second seal defining a second cross-sectional sealing area oriented perpendicular to the longitudinal axis of the activation member;

wherein the tool is configured to selectively vary the effective sealing area of the activation member by selectively transferring effective sealing of the activation member between the first seal and the second seal.

6. The tool according to claim 5 further comprising a first fluid chamber fluidly communicating the second seal with a fluid within the body; and a cross-sectional flow area between the internal body fluid and the first fluid chamber, wherein the cross-sectional flow area is substantially smaller in the first configuration than in the second configuration.

7. The tool according to claim 6 further comprising a flow restriction defining at least a portion of the cross-sectional flow area.

8. The tool according to claim 1 further comprising:

a mechanical biasing member disposed in the body and configured to exert a mechanical biasing force on the activation member.

9. A method of under-reaming comprising:

running an under-reaming tool into a bore, wherein the under-reaming tool comprises a body and a plurality of extendable cutters moveably coupled to the body, wherein the cutters have an extended position relative to the body and a retracted position relative to the body, and an activation member configured to move the cutters between the retracted position and the extended position, the activation member comprising an effective sealing area;

cycling the under-reaming tool between a first configuration with the cutters in the retracted and a second configuration with the cutters moveable between the retracted position and the extended position;

selectively varying a hydraulic bias of the activation member selectively varying the effective sealing area;

preventing transition of the cutters to the extended position in response to an external fluid pressure in at least one of the first and second configurations;

transitioning the cutters to the extended position in the second configuration;

under-reaming a section of bore;

transitioning the cutters to the retracted position with the under-reaming tool in the second configuration; and cycling the under-reaming tool to the first configuration.

10. The method of claim 9, wherein the cutters are transitioned to the extended position in the second configuration in response to an internal fluid pressure.

11. The method of claim 10, wherein the cutters are transitioned to the extended position in the second configuration in response to a fluid pressure in a bore of the under-reaming tool that is greater than the external fluid pressure.

12. The method of claim 9, further comprising preventing the extension of the cutters when the external fluid pressure exceeds an internal fluid pressure.

13. The method of claim 9, further comprising ensuring the retraction of the cutters in at least one of the first and second configurations when the external fluid pressure exceeds an internal fluid pressure.

14. The method of claim 9, further comprising selectively varying the effective sealing area by selectively transferring the effective sealing area of the activation member between a first seal and a second seal.

15. A downhole tool comprising:

a body;

an extendable member coupled to the body, wherein the extendable member has an extended position extending from the body and a retracted position retracted into the body, the downhole tool configured to be cycled between a first configuration in which the extendable member is in the retracted position and a second configuration in which the extendable member is movable between the retracted position and the extended position; and an activation member configured to move the extendable member between the retracted position and the extended position, the activation member comprising an effective sealing area, wherein the downhole tool is configured to selectively vary the effective sealing area of the activation member to selectively vary a hydraulic bias of the activation member; and wherein the downhole tool is configured to prevent the transition of the extendable member to the extended position in response to an external fluid pressure outside the body in at least one of the first and second configurations.

16. The tool of claim 15 wherein the extendable member is configured to transition to the extended position only with the tool in the second configuration.

17. The tool of claim 15, wherein the downhole tool is configured to allow transition of the extendable member to the extended position only in response to an internal fluid pressure within the body.

18. The tool of claim 15, further comprising a counterpiston disposed in the body, wherein the counterpiston is configured to transition the extendable member to the retracted position or prevent transition of the extendable member to the extended position when the external pressure fluid pressure is greater than an internal fluid pressure within the body.

19. The tool of claim 18, wherein the counterpiston is configured to transition the extendable member to the retracted position or prevent transition of the extendable member to the extended position when the tool is in at least one of the first and second configurations.

20. The tool according to claim 15, wherein the tool further comprises:

a first seal defining a first cross-sectional sealing area oriented perpendicular to a longitudinal axis of the activation member; and a second seal defining a second cross-sectional sealing area oriented perpendicular to the longitudinal axis of the activation member;

wherein the tool is configured to selectively vary the effective sealing area of the activation member by selectively transferring effective sealing of the activation member between the first seal and the second seal.

21. The tool according to claim 20, wherein in use there is an effective pressure differential across the first seal in the first configuration and an ineffective pressure differential across the first seal in the second configuration of the tool in use.

22. The tool according to claim 15, further comprising:

a mechanical biasing member disposed in the body and configured to exert a mechanical force on the activation member.

* * * * *